US006056652A

United States Patent [19]

Lees et al.

[11] Patent Number: 6,056,652

[45] Date of Patent: May 2, 2000

[54] BASKETBALL RETRIEVAL DEVICE

[75] Inventors: Charles W. Lees, Milford, Mass.; Jeffrey Sparr, Providence, R.I.; Stephen Lane, Jamestown, R.I.; Dan McGrail, Chepachet, R.I.; Justin Sirotin; Aidan Petrie, both of Providence, R.I.

[73] Assignee: HoopMaster, Inc., Milford, Mass.

[21] Appl. No.: 09/047,974

[22] Filed: Mar. 25, 1998

[51] Int. Cl.[7] ..... A63B 63/08; A63B 69/00

[52] U.S. Cl. ..... 473/433

[58] Field of Search ..... 473/432, 433

[56] References Cited

U.S. PATENT DOCUMENTS

| | | |
|---|---|---|
| D. 260,669 | 9/1981 | Armstrong . |
| D. 260,670 | 9/1981 | Armstrong . |
| D. 384,714 | 10/1997 | Bradley . |
| 1,765,269 | 6/1930 | Hatley . |
| 1,924,757 | 8/1933 | Shisoff . |
| 3,233,896 | 2/1966 | King . |
| 3,342,486 | 9/1967 | Farley . |
| 3,776,550 | 12/1973 | McNabb . |
| 3,814,421 | 6/1974 | Spier, Jr. . |
| 3,901,506 | 8/1975 | Caveney . |
| 3,913,916 | 10/1975 | Martin, Jr. . |
| 3,917,263 | 11/1975 | Wiley . |
| 4,291,885 | 9/1981 | Cohen . |
| 4,579,339 | 4/1986 | Grimm . |
| 4,579,340 | 4/1986 | Jenkins et al. . |
| 4,667,957 | 5/1987 | Joseph . |
| 4,678,189 | 7/1987 | Koss . |
| 4,697,810 | 10/1987 | Mathison . |
| 4,706,954 | 11/1987 | Kershaw . |
| 4,714,248 | 12/1987 | Koss . |
| 4,720,101 | 1/1988 | Farkas, Jr. . |
| 4,786,053 | 11/1988 | Barnes, Jr. . |
| 4,786,371 | 11/1988 | Postol . |
| 4,836,539 | 6/1989 | Knapp . |
| 4,838,549 | 6/1989 | Woodall . |
| 4,869,502 | 9/1989 | Wares . |
| 4,936,577 | 6/1990 | Kington et al. . |
| 4,955,605 | 9/1990 | Goldfarb . |
| 5,016,875 | 5/1991 | Joseph . |
| 5,060,940 | 10/1991 | Mullen . |
| 5,098,090 | 3/1992 | Juhl . |
| 5,133,546 | 7/1992 | Matherne et al. . |
| 5,165,680 | 11/1992 | Cass . |
| 5,171,009 | 12/1992 | Filewich et al. . |
| 5,184,814 | 2/1993 | Manning . |
| 5,207,789 | 5/1993 | Gates . |
| 5,273,275 | 12/1993 | Wilkerson . |
| 5,308,059 | 5/1994 | Owen, Jr. et al. . |
| 5,312,099 | 5/1994 | Oliver, Sr. . |
| 5,348,290 | 9/1994 | Matherne et al. . |
| 5,364,091 | 11/1994 | Sebek . |
| 5,364,092 | 11/1994 | Riepe et al. . |
| 5,368,292 | 11/1994 | Metz . |
| 5,409,211 | 4/1995 | Adamek . |
| 5,507,483 | 4/1996 | Hektor . |
| 5,603,495 | 2/1997 | Noveck . |
| 5,681,230 | 10/1997 | Krings . |
| 5,692,976 | 12/1997 | Yu . |
| 5,746,668 | 5/1998 | Ochs . |

*Primary Examiner*—William H. Grieb
*Attorney, Agent, or Firm*—Wolf, Greenfield & Sacks, P.C.

[57] ABSTRACT

Basketball retrieval devices are provided. The devices have use and storage positions, whereby the devices include collapsible walls that permit the devices to be collapsed into a compact storage position and opened into a use position for permitting a player to practice foul-throw shooting.

48 Claims, 7 Drawing Sheets

BASKETBALL RETRIEVAL DEVICE

FIELD OF THE INVENTION

The present invention relates, in general, to the field of basketball, and, in particular, to basketball retrieval devices for returning a basketball to a player. One embodiment of the invention is directed specifically to improving the foul-shooting capability of a player.

BACKGROUND OF THE INVENTION

Basketball has emerged as the fastest growing major sport in the United States. A recent study indicated that more than 46 million Americans played basketball at least once in 1996. The sport is seeing similar growth and popularity outside the United States as well. Many are serious players; almost 13 million Americans played basketball more than 50 times in 1996.

About 30% of the points scored in a basketball game are scored from the foul-line. Most close games are won or lost at the foul line. There exists a need for devices which can help a player improve foul-shooting.

A variety of basketball-related devices is available. This variety is illustrated in the following U.S. Pat. Nos.: 1,765,269, 3,233,896, 3,342,486, 3,776,550, 3,814,421, 3,901,506, 3,917,263, 3,913,916, 4,291,885, 4,579,339, 4,579,340, 4,667,957, 4,678,189, 4,697,810, 4,706,954, 4,714,248, 4,720,101, 4,786,053, 4,786,371, 4,836,539, 4,838,549, 4,869,502, 4,936,577, 4,955,605, 5,016,875, 5,060,940, 5,098,090, 5,129,648, 5,133,546, 5,165,680, 5,171,009, 5,184,814, 5,273,275, 5,308,059, 5,312,099, 5,348,290, 5,368,292, 5,409,211, 5,507,483, 5,540,428, 5,692,976.

The various prior art devices have numerous drawbacks. Many of the devices return the ball to the player only if the basketball goes through the basketball hoop. Other devices are constructed whereby the netting does not permit the basketball player to have a clear line-of-sight to the basketball rim, it being necessary for the player to look through the netting to see the rim and to arch the ball above the netting in order to have the basketball go through the hoop. Almost all of the prior art devices require an existing basketball rim and backboard arrangement, whereby the devices are adaptable to such existing backboard and rims. As a result, valuable court-space must be taken up in order to practice basketball free-throw shooting. Another drawback of many of the prior art devices is that their assembly is complex, and it is difficult, if not impossible, to easily collapse the basketball-retrieval devices into a compact storage position.

SUMMARY OF THE INVENTION

According to one aspect of the invention, a basketball retrieval device for use with a basketball is provided. The device includes a frame having, in a use position, a top and a bottom. The frame includes a pair of first support arms spaced-apart from one another along their lengths, preferably lying in a first support arm plane, the first support arms defining a pair of first flexible wall attachment locations toward the top of the frame. The first flexible wall attachment locations are spaced between 20" and 72" from one another. The frame also includes a pair of second support arms attached to the first support arms and pivotable with respect to the first support arms, each second support arm having a proximal end adjacent the first support arms and a distal end in the use position remote from the first support arms, each distal end equidistant from a respective first support arm in the use position, the distal ends defining second flexible wall attachment locations spaced between 30" and 72" from one another. The second support arms also are spaced-apart from one another along their lengths. The retrieval device further includes a chute having a proximal end adjacent the first support arms and a distal end remote from the first support arms, the chute being at least 48" in length and extending over most of its length downwardly at an angle of between 10 and 45 degrees from horizontal. The device has a first flexible, collapsible wall attached to one of the first flexible wall attachment locations and to its respective second flexible wall attachment location. The wall also is attached along a length of at least 48" of a first side of the chute. The device further has a second flexible, collapsible wall attached to the other of the first flexible wall attachment locations and to its respective second flexible wall attachment location. The second wall is attached along a length of at least 48" of a second side of the chute. The second support arms are pivotable from the use position to a storage position in which the second support arms lie substantially parallel to the first support arms and in which the flexible, collapsible wall is collapsed.

In one embodiment, the device further includes means for securing the frame with respect to a basketball rim and positioning the first flexible wall attachment locations behind the rim and at least 24" above the basketball rim.

In another embodiment, the device further includes collapsible material attached to the frame at the first support arms or adjacent thereto and attached to the second support arms as well. A first length of collapsible material limits pivotable movement of the second support arms and defines, by such limiting, the use position of the second support arms.

In a preferred embodiment, the flexible collapsible wall is netting and the collapsible material is fabric defining a border of the netting. A second length of collapsible material limiting pivotable movement of the chute can be provided. This material defines, by such limiting, the use position of the chute.

In one embodiment the device also has an extendable upright support for positioning the flexible collapsible walls with respect to a basketball rim.

In another embodiment, the frame further comprises a rigid frame member attached to the distal end of the chute.

In still another embodiment, the frame can further include a cross-bar attached to the first support arms with stops for locating the cross-bar on the neck of a basketball rim. The frame also can have a pair of L-shaped arms extending behind the first support arm plane for engaging a backboard. In other embodiments, different means for securing the device to a basketball rim are provided.

The chute can have non-rigid or rigid sides. In some embodiments, it is important that the chute have non-rigid sides whereby the chute may be rolled, folded or collapsed into a storage position. In other embodiments the chute has rigid sides and the chute is pivotably-attached to the frame, whereby the chute can be moved from the use position to a storage position in which the chute is substantially parallel to the first support arms. When the chute has rigid sides, the chute can have a chute cross-bar at the distal end for stabilizing the chute. Preferably the cross-bar is remote from a plane defined by the rigid sides.

In one embodiment, the distal ends of the second support arms and the distal end of the chute define a trapezoidal opening.

In one important embodiment, the frame further comprises an extendable, telescoping arm, the telescoping arm extendable downwardly from the bottom of the frame for lifting the frame to a rim or backboard.

According to another aspect of the invention, a framework for attachment to a basketball rim is provided. The framework includes a first pair or arms lying substantially in a plane and spaced apart from one another along their lengths. The frame includes also a second pair of arms spaced-apart from one another along their lengths, the second pair pivotably attached to the framework and moveable between a storage position, in which the second pair of arms is substantially parallel to the plane, in a use position, in which the second pair of arms extends outwardly and upwardly from the plane when the framework is oriented for attachment to a rim. The framework also includes a third pair of arms spaced-apart from one another along their lengths, the third pair of arms pivotably attached to the framework and moveable between a storage position in which the third pair of arms is substantially parallel to the plane, in a use position, in which the third pair of arms extends outwardly and downwardly from the plane when the framework is oriented for attachment to a rim. The framework also includes means attached to the second pair of arms and the third pair of arms for limiting pivotable movement of the second and third pair of arms and defining the use position by limiting such pivotable movement, and means for attaching the framework to a basketball rim.

In one embodiment, the means for attaching the framework to a rim releaseably attaches the framework indirectly to the basketball rim via attachment to a basketball backboard. In another embodiment, the means for attaching the framework to the basketball rim comprises a cross-bar of the framework. In one important embodiment, the cross-bar includes stops for locating the framework on the neck of a basketball rim.

The framework can comprise a pair of cross-bars attached to the first pair of arms. The framework also can comprise at least one extendable arm attached to the framework for lifting the framework to its placement about a basketball rim. This extendable arm can be a pair of extendable arms telescoping within the framework. Each of the telescoping arms can telescope with a respective one of the first pair of arms.

In one important embodiment, the first pair of arms forms with the second pair of arms substantially a right triangle in the use position. In another important embodiment, the attachment means comprises L-shaped arms attached to the framework and extending in two directions outside of the plane of the first arms.

In still another important embodiment, the device further comprises a pair of collapsible walls attached to the arms. The arms and the walls can be configured as a pair of wedge-shaped fans.

In one important embodiment, the means attached to the second pair of arms and the third pair of arms for limiting pivotable movement of such arms is collapsible material.

According to another aspect of the invention, a framework for attachment to a basketball rim is provided. The framework includes (1) a first pair of arms lying in a plane and spaced-apart from one another along their lengths, (2) a second pair of arms attached to the framework and spaced-apart from one another along their lengths, forming on the upper side thereof with the first pair of arms an acute angle, (3) a third pair of arms attached to the framework and spaced-apart from one another along their lengths, the third pair of arms forming on the upper side thereof with the first pair of arms an obtuse angle, and (4) a collapsible wall attached to the first, second and third pair of arms.

In one embodiment, the second arms and third arms are pivotably attached to the framework. In this embodiment, the second pair of arms and the third pair of arms can be pivotable into a storage position in which the second pair of arms and the third pair of arms lie substantially in the plane.

In another embodiment, the framework includes cross-bars attaching the first pair of arms to one another.

In another embodiment, the framework includes retractable lift-arms received telescopically within the first pair of arms.

In yet another embodiment, the framework includes an arrangement wherein the second arms and third arms are pivotably attached to the framework, wherein each of the second pair of arms has an end adjacent the plane of the first pair of arms and each of the third pair of arms has an end adjacent the plane defined by the first pair or arms, and wherein the ends of the second pair of arms are spaced vertically from the ends of the third pair of arms by at least 6".

According to another aspect of the invention, a basketball retrieval device is provided. The device includes a backboard defining a plane, a rim attached to the backboard, a pair of collapsible panels detachably secured to one or both of the rim and a backboard, and a chute. One of the panels extends on the left side of the rim from the backboard forward of the rim and the other of the panels extends on the right side of the rim from the backboard forward of the rim. The pair of panels has top front corners and bottom front corners, wherein the bottom front corners are spaced-apart at a first distance and the top front corners are spaced apart at a second distance, and wherein the second distance is at least 50% longer than the first distance. The chute has two sides, each side of the chute attached along its length to a respective panel, the chute being at least 48" in length.

In one embodiment, the chute is free of attachment to any structure on a basketball playing surface other than a post arrangement supporting a backboard. In other words, the chute is free, substantially along its length, of structure extending to the playing surface beneath the chute. The chute can be supported by a pair of arms pivotable into a storage position in parallel alignment with the plane. The chute pivots can be fabric hinges, although mechanical metal hinges are preferred. In another embodiment, the panels comprise a plurality of arms pivotable into parallel alignment with the plane.

Each collapsible panel can be netting, fabric attached to the netting and a plurality of arms attached to the fabric, each panel configured as a wedge-shaped fan. The arms can be received in fabric sleeves substantially along their lengths. Preferably each panel has a top side, the top side positioned along its length at least 20" above the rim in the use position. Most preferably, each panel is a trapezoid comprising a vertical side extending parallel to the plane adjacent the backboard, a top side position at least 12" above the rim along its length, a front side longer than the top side and extending from the top side downwardly and forming with the top side an obtuse angle, and a bottom side extending downwardly from the vertical side to the front side and forming with the front side an acute angle. Most preferably, the panels are collapsible to a configuration substantially parallel to the plane. The panels can be supported on a frame which is detachably secured to the rim, for example, by a cross-bar on the frame in one embodiment.

According to another aspect of the invention, a basketball hoop arrangement is provided. The arrangement includes an upright support having a front and a side. A basketball rim is attached to the upright support and defines with the upright support a center plane which extends frontwardly from the upright support through the center of the rim. A front net support arm is attached to the upright support and extends forwardly and upwardly from the support and ends at a first net suspension point at least 18" above the rim, preferably not more than 36" to the side of the rim and at least 12" in front of the rim. The front net support arm is positioned on a single side of the center plane. A net is supported on the front net support arm for restricting lateral movement of a ball bouncing off of the rim. In one embodiment, a side net support arm attached to the upright support extends sidewardly and upwardly from the upright support, transverse to the center place, and ends at a second net suspension point at least 20" above the rim and behind and to the side of the rim, wherein the net is also supported on the net side support arm.

In one embodiment, the front net support arm is a pair of first net support arms, one of the pair extending only on the left side of the center plane and the other of the pair extending only on the right side of the center plane, wherein the first net suspension point is a pair of first net suspension points, one on the left side of the center plane and another on the right side of the center plane, and spaced-apart from one another by at least 30". The side net support arms can be a pair of side net support arms attached to the upright support and extending sidewardly and upwardly from the upright support and ending at a pair of second net suspension points at least 20" above the rim and behind the rim, one of the second net suspension points on the left side of the center plane and the other on the right side of the center plane.

Preferably, the front net support arms are pivotable from a vertical-orientation in a storage position to the frontward orientation in a use position. Most preferably, the front net support arms are longer than the side net support arms.

In one embodiment, the net support arms are positionable at least two vertically remote locations on the upright support. This can be accomplished, for example, by attaching the net support arms to a plate that is slidable with respect to the upright support.

In another embodiment, a chute is provided, the chute being attached at the upright support and extending frontwardly and downwardly from the upright support to direct a ball landing on the chute in a preselected direction away from the rim. Preferably, the chute is at least 48" long, preferably at least 60" long and in one embodiment is more than 72" long. The chute is angled substantially along its length between 10° and 45°.

According to another aspect of the invention, a basketball hoop arrangement is provided. The arrangement includes an upright support having a front and a side, a basketball rim attached to the upright support, a collapsible wall attached to the upright support and a ball return chute attached to a support arm extending downwardly from the beneath the rim and away from the rim. The collapsible wall, in a use position, surrounds a rear side and at least one lateral side of the basketball rim, the wall extending at the rear side of the rim at least 20" above a horizontal plane defined by the basketball rim and the wall defining a ball discharge opening. The basketball hoop arrangement is free of a non-collapsible backboard, and the basketball hoop arrangement has a storage position in which the collapsible wall, including the wall surrounding the rear side, is collapsed into a compact orientation.

In one important embodiment, the wall comprises three panels, a rear panel disposed, in the use position, substantially vertically behind the rim, a left side panel disposed, in the use position, substantially vertically at the left side of the rim, and a right side panel disposed, in the use position, substantially vertically at the right side of the rim. In this embodiment, the device can include a first pair of rigid support arms attached to the upright support and attached to opposite sides of the rear panel, the pair of support moveable between the use and the storage positions, wherein the pair of supports are spread apart from one another at their upper ends in the use position to define the rear panel and wherein the pair of supports are moved closer together at their upper ends in the storage position, thereby collapsing the rear panel. This embodiment also can include a second pair of rigid support arms, one extending in the use position frontwardly on the left side of the rim and attached to the left side panel and the other extending in the use position frontwardly on the right side of the rim and attached to the right side panel, the second pair of arms extending at respective panel suspension points above and in front of the rim in the use position, wherein the second pair of arms are moveable from the use position to an orientation substantially parallel to the upright support in the storage position.

In another embodiment, the upright support is a pair of upright sections slidable with respect to one another between the use position in which the upright support is at least approximately 10' in length and the storage position in which the upright support is less than 7' in length. The upright support can include a counterweight to facilitate movement of the pair of upright sections. In another embodiment, the wall is slidably attached to the upright support between the use position and the storage position.

The wall can be supported by a plurality of support arms pivotably attached to the upright support, wherein pivoting of the support arms moves the wall from the use position to the storage position in which the wall is collapsed. The wall and the arms can be configured as a wedged fan. In this arrangement, the device can have a plurality of support arms which are pivotably attached to the upright support via attachment to a plate which in turn is slidably attached to the upright support. Preferably, the wall comprises a rear panel which is fabric.

According to another aspect of the invention, a basketball retrieval device is provided. The device has a base, a lower upright support extending vertically from the base, an upper upright support attached to and extending vertically from the lower upright support, a collapsible net arrangement attached to the upper upright support and a ball return chute attached to the net and extending downwardly from horizontal and away from the upper upright support. The upright supports are slidably attached to one another to move between a storage non-extended position and an extended use position. A counterweight can facilitate this movement. The collapsible net arrangement is slidable from a net storage position towards one end of the upper upright to a net use position towards the other end of the upper upright.

In one embodiment, the device further comprises a rim secured to and immovable with respect to the upper upright support.

In another embodiment, the device comprises a distal chute support pivotably attached to the base at one end and to a distal end of the chute at the other end. The distal chute support can be attached to the chute at least 7' from the lower upright in one embodiment. In one particularly important embodiment, the distal chute support is attached to the chute approximately 15' from the lower upright. The distal chute can comprise two sections slidably attached to one another.

In a preferred embodiment, it comprises three sections, a first and a second of the sections arranged substantially horizontally in the chute use position, and a third section extending upwardly from the second section and defining a ball retrieval stop in the chute use position. All three can be telescopically collapsed in the storage position. Preferably, the distal chute is pivotable from the use position to a vertically-disposed storage position.

According to another aspect of the invention, a basketball retrieval device is provided. The device has a storage position and a use position. The device includes a base, a lower upright support extending vertically from the base, an upper upright support attached to and extending vertically from the lower upright support, the upright supports slidable with respect to one another between the storage position and the use position, a collapsible net arrangement attached to the upper upright support, a ball return chute attached to the net and extending downwardly from horizontal and away from the upper upright support in the use position, and a distal chute support pivotably attached to the base at one end, the distal chute support pivotable from a horizontally-disposed use position to a vertically-disposed storage position.

In one embodiment, the device further comprises a rim secured to the upper upright support. The distal chute support can be attached to the chute at least 7' from the lower upright, and in one preferred embodiment is attached to the chute approximately 15' from the lower upright. The distal chute support can comprise two or even three sections slidably attached to one another, preferably telescopically arranged. In a preferred embodiment, the first and second of a three-sectioned distal chute support are arranged substantially horizontally in a chute use position and a third section extends upwardly from the second section to define a ball retrieval stop in the chute use position. A counterweight can be provided to facilitate movement of the lower and upper upright supports relative to one another.

In one embodiment, the net arrangement includes a pair of side panels substantially vertically disposed and spaced-apart at their top and bottoms not more than 5', wherein the net arrangement defines an elongated opening free of netting between the side panels whereby a basketball player has a clear line-of-sight to throw a basketball toward a rim between the side panels. In one embodiment, the net arrangement is closed at an end of the side panels opposite the opening.

According to another aspect of the invention, a basketball retrieval device is provided. The basketball retrieval device includes a base, an upright support attached to the base, the upright support being vertically oriented and lying in a first plane, the upright support having a front, a left side and a right side. A left upright arm is attached to the upright support and extends on the left side, substantially parallel to the plane, to a first net attachment point on the left side of the upright support. A right upright arm is attached to the upright support and extends on the right side, substantially parallel to the plane, to a second net attachment point on the right side of the upright support. A left front arm is attached to the upright support and extends frontwardly and upwardly on the left side of the upright support to a third net attachment point, the third net attachment point being on the left side of the upright support and at least 2' forward of the upright support. A right front arm is attached to the upright support and extends frontwardly and upwardly on the right side of the upright support to a fourth net attachment point, the fourth net attachment point on the right side of the upright support and at least 2' forward of the upright support. An elongate flexible chute extends downwardly from horizontal and forward from the upright support. Left side netting is attached to the first and third net attachment points and is attached along a length of the left side of the chute. Right side netting is attached to the second and fourth net attachment points and is attached along a length of the right side of the chute. An elongated opening defined by the left side netting and the right side netting, whereby a basketball player has a clear line-of-sight to throw a basketball toward a rim between the left side netting and the right side netting.

In one embodiment, the arms are pivotable with respect to the upright support. In another embodiment, a rim is attached to the upright support. In still another embodiment, the device further comprises a rim attached to the upright support, wherein the upright support is free of attachment to a rigid backboard.

According to another aspect of the invention, a basketball hoop arrangement is provided. The arrangement includes: (1) an upright support, (2) a basketball rim attached to the upright support, the basketball rim having a left side, a right side and a rear side, (3) a collapsible wall moveably attached to the upright support and, in a use position, surrounding the rim along the left, right and rear sides of the rim, the collapsible wall extending at the left, right and rear sides of the rim at least 20" above a horizontal plane defined by the rim in the use position, (4) a ball return chute attached to the wall, and (5) an opening in one of the chute or the wall, or both of the chute and the wall, wherein the upright support passes through the opening, and wherein the wall and the chute can be moved via the opening along a length of the upright support. The collapsible wall can be netting and fabric. The collapsible wall also can comprise fabric at the rear side of the basketball rim and netting at the left and right sides of the basketball rim.

According to another aspect of the invention, a basketball retrieval device is provided. The device includes a base, an upright support attached to the base, a netting arrangement for retrieving a basketball entering the netting arrangement, a plate attached to the upright support, a first pair of support arms pivotably attached to the plate and pivotable within a first plane, a second pair of support arms pivotably attached to the plate and pivotable substantially transverse to the first plane, wherein the second pair of support arms are attached to the plate and pivotable along surfaces of the plate that are angled with respect to the first plane.

In one embodiment, the plate is moveable along the length of the upright support. In another embodiment, each of the second pair of support arms has a bend of more than 45°. Preferably the bend is between 75° and 105°. The second pair of support arms can be pivotable within channels attached to the plate. Preferably, the plate comprises handles for moving the plate along the upright support. Also, it is preferred that the plate include means for securing the plate at more than one location along the upright support.

According to another aspect of the invention, a basketball retrieval device is provided. The device includes an upright support, a basketball rim attached to the support, a flexible wall arrangement attached to the support, wherein the wall arrangement includes a back panel and two side panels, each side panel including a first wedge segment and a second wedge segment, a pair of pivotable arms, pivotable from the storage position in which the first wedge segments are collapsed, to a use position in which the first wedge segments are configured as triangles, wherein the first and second wedge segments of each side panel share a side defined by one of the pivotable arms, and a chute attached to a side of each of the second wedge segments.

According to another aspect of the invention, a basketball rim assembly including a shock absorber is provided. The assembly includes a basketball rim having a neck and an attachment plate. The attachment plate is secured via bolts, rivets or the like to a solid support. Captured between the attachment plate of the rim and the solid support is a shock absorber. The shock absorber can take on any of a variety of conventional forms, but particularly preferred is a simple pad. The shock absorber reduces the degree to which a basketball bounces upwardly from the rim by at least 10%, preferably 20% and more preferably 30% compared to the degree to which the basketball would bounce upwardly off of the rim if it were attached rigidly to the solid support. Measurements can be made when the basketball is thrown in a conventional manner from the foul line placed 15' from the solid support.

The device can include a back panel that is made of fabric. Preferably the side panels comprise netting. Most preferably, the wedge segments are substantially triangular.

DETAILED DESCRIPTION OF THE INVENTION

The invention features devices that return a basketball to the basketball player, whether or not the basketball player makes a basket. The preferred embodiments feature devices that have both a use position and a storage position, whereby the device may be collapsed into a relatively small space in the storage position.

Figure 1:
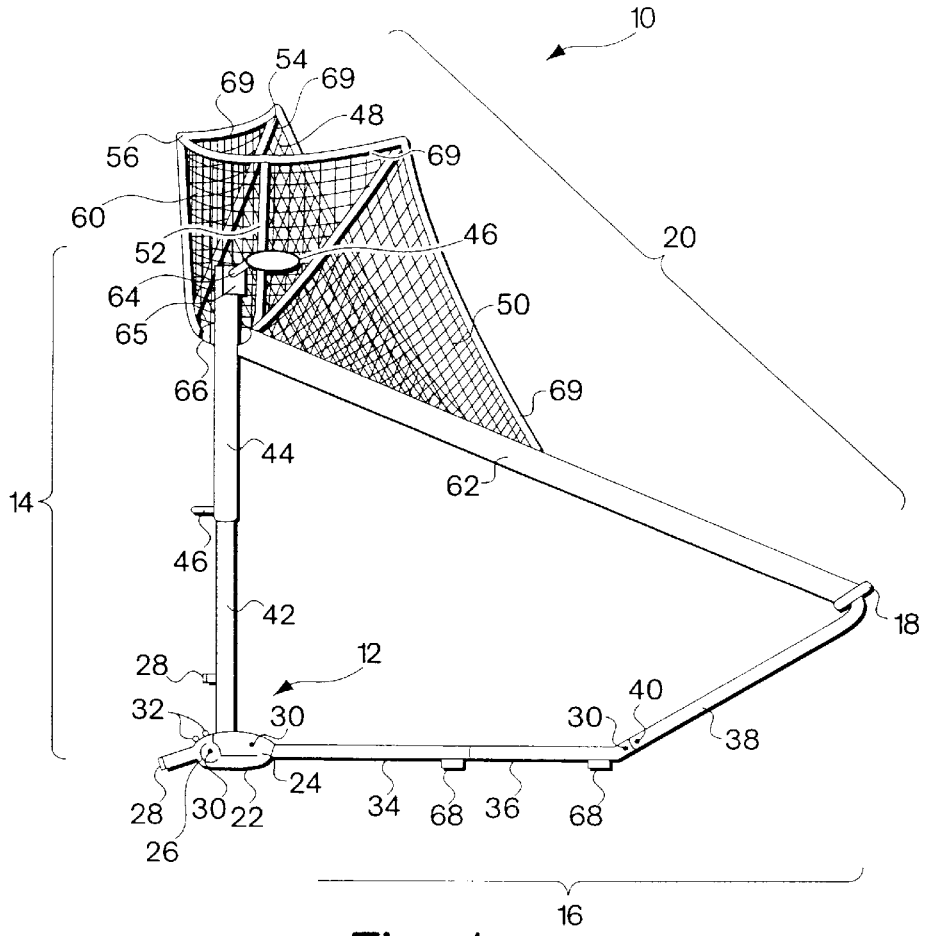
FIG. 1 is a perspective view of a basketball retrieval device according to the invention, in the use position.

FIG. 1 depicts one important embodiment of the invention, wherein the device is particularly adapted to improve the foul-shooting ability of a player. The basketball retrieval device 10 of FIG. 1 has four principal elements: a base 12 for resting on a flat surface, an upright support 14 extending vertically from the base 12, a distal chute support 16 extending horizontally from the base 12 and ending at a distal chute attachment bar 18, and a net/chute assembly 20 supported at an upper end of the upright support 14 and extending to the distal chute attachment bar 18, for capturing and returning a basketball to a player.

Figure 2:
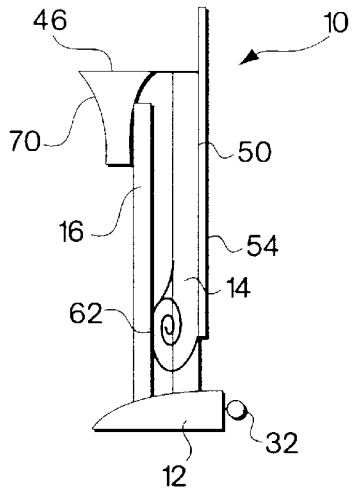
FIG. 2 is a schematic view of a basketball retrieval device according to the invention, in the storage position.

The basketball retrieval device 10 is made from a number of telescoping, pivotable and/or collapsing parts, whereby the device may be moved from its use position, depicted in FIG. 1, to its storage position, depicted in FIG. 2.

The base 12, upright support 14 and distal chute support 16 are, in the preferred embodiment, aluminum. The upright support and the distal chute support are hollow, square, telescoping tubes. This permits a great deal of strength while maintaining a relatively light weight. Virtually any other metal, however, may be used. In addition, the device can be fabricated of synthetic plastics or even wood. The description is not intended to be limited to any particular material, unless such is indicated.

The base 12 includes a generally flat base-plate 22, which is generally in the shape of a triangle with rounded corners and somewhat elliptical sides. A pair of base-plate support brackets 24 are welded to the base-plate and extend vertically therefrom, to create a channel for receiving ends of the upright support 14 and the distal cute support 16. The upright support 14 and the distal chute support 16 are attached to the support brackets 24 of the base 12. The distal chute support 16 is pivotably attached to the support brackets 24. Pairs of smaller leg brackets 26 extend vertically from the base-plate 22, one pair on each side of the support brackets 24, thereby providing an additional channel for receiving and seating by pivotable attachment a pair of balancing legs 28. A pivot pin 30 passes through the leg brackets and balancing legs, whereby the balancing legs can be pivoted from the storage position in which they are vertically-oriented to the use position in which they are horizontally oriented. A locking pin (not shown) can be provided to pass through an aligned opening (not shown) in the balancing legs 28 and leg brackets 26 to lock the balancing legs in the use position. A similar arrangement can be provided to secure the legs in the storage position. A pivot pin 30 also is provided at the attachment of the distal chute support 16 and the support brackets 24, whereby the distal chute support may be pivoted from the use position in which it is horizontally oriented to the storage position in which it is vertically-oriented. As with the leg brackets, a locking pin may be used to secure the distal chute support 16 in either or both of the use and storage positions.

It is noted that virtually any routine pivotal attachment and locking mechanism can be used for attaching the distal chute support 16 to the support brackets 24 and/or the balancing legs 28 to the leg brackets 26. Thus, pins, grooved arrangements, detents, swivels, and the like can be used for these purposes. It likewise is noted that while the base 12 is shown with the support brackets 24 and leg brackets 26 welded thereto, the base-plate 22, support brackets 24 and leg brackets 26 can be molded as a unitary piece. It is also possible that the distal chute support be and/or balancing legs attached to the base other than by a pivot. For example, the base 12 can have a pair of openings, one oriented vertically and another oriented horizontally. These openings can be sized to receive the distal chute support 16. In this manner, when the distal chute support is inserted into the vertically-oriented opening, the distal chute support is placed in the storage position. Likewise, when the distal chute support is inserted into the horizontally disposed opening, the distal chute support is placed in the use orientation. Similar configurations could be created for the balancing legs. The fit in such a configuration could be a friction fit or it could be simply a tight fit, with a pin or other such implement to lock the distal chute support or the balancing leg in place.

As can be seen from FIG. 1, when the distal chute support 16 and the balancing legs 28 are extended in their use positions, they form essentially a tripod for stabilizing the base 12. When the distal chute support 16 and balancing legs 28 are disposed vertically in the storage position, then only the base-plate 22 contacts the flat surface upon which the device rests.

The base 12 further is provided with a pair of wheels 32 at the rear of the base-plate, whereby the device may be tipped backward in the storage position onto the wheels 32, and the device may be wheeled for storage much like a dolly.

The distal chute support 16 is made up of three sections, a first section 34, a second section 36, and a third section 38. These sections are telescoping with respect to one another, the third section 38 telescoping into the second section 36, and both the third section 38 and second section 36 telescoping into the first section 34. When the three sections are collapsed in coaxial arrangement, they can be pivoted from the use position to the vertically-oriented storage position. In the use position, however, these sections are extended with respect to one another. The first section 34 and the second section 36 extend horizontally from the base 12. The third section 38 extends at an angle from the distal end of the second section 36 to define a distal chute attachment location (attachment bar 18) 15' from the upright support 14. This is the distance between a backboard and the foul line of a basketball court. Thus, the second section 36 is joined by a pivot pin 30 and a locking pin 40 for locking the second section 36 and third section 38 in an angled relationship for the use position. The distal end of the second section 36 is also provided with a pad 68 on its bottom surface for resting on the flat surface (i.e. a floor).

The upright support 14 is made of a pair of telescoping sections, a lower portion 42 and an upper portion 44. Thus, the upper portion 44 can be collapsed upon the lower portion 42, in a telescoping coaxial configuration, to define the storage position whereby the combined height of the lower portion and the upper portion is under 7', and preferably about 6' to permit storage in a closet. When the upper portion 44 is extended from the lower portion 42 by lifting handles 46, the top of the upper portion 44 which carries a basketball rim can be positioned whereby the rim is 10' above the bottom of the base 12. This also is the same distance as is conventional in a basketball court.

A counter-weight assembly permits easy lifting of the upper portion relative to the lower portion. The counter-weight assembly is described below in connection with FIGS. 15 and 16.

Also carried by the upright support 14 is a net/chute assembly 20. This net/chute assembly 20 is slidable upon the upper portion 44 of the upright support 14, wherein the net/chute assembly is toward the top of the upper portion 44 in the use position and is toward the bottom of the upper portion 44 in the storage position. The net/chute assembly 20 includes a left side net 48 and a right side net 50 supported above the basketball rim by two pair of arms extending from the upper portion of the upright support. A first pair of arms extends at the rear of the basketball rim, side net support arms 52. The side net support arms lie in a vertically-oriented plane which would be parallel to a backboard, if present. The left and right side nets 48, 50 also are supported by front net support arms 54 which extend from the upright support 14 outwardly and upwardly from the side net support arm plane.

The side net support arms 52 extend upwardly at the rear of and above the basketball rim 46 to define a first pair of net attachment locations above and to the rear of the basketball rim. The front net support arms 54 extend upwardly and frontwardly above the basketball rim to define a second pair of net attachment locations in front of and above the basketball rim. The first pair of net attachment locations 56 and the second pair of net attachment locations 58 are between 20" and 40" above the basketball rim. The height of the netting is important. If the netting is not high enough, then a basketball will bounce too frequently over the net. Likewise, if the netting is too high, then storage into a compact space is not practical. The preferred height above the basketball rim of the net attachment location is 32".

Another aspect of the dimensions of the device that is important is the spacing between the left side net 48 and the right side net 50. The left side net and the right side net, generally speaking, are spaced from the nearest point on the basketball rim at least the width of a basketball. Since the front net support arms are substantially fixed in relation to the rim, if the front net support arms 54 and the rim are closer to one another than the width of a basketball, then the basketball might become lodged between them, thereby preventing return of the ball to the player. The net, on the other hand, has a certain amount of flexibility in it and, therefore, it is possible that the net can be slightly closer to the rim, depending on how taut the net is. In the preferred embodiment the front net support arms 54 are no closer than 12" to the basketball rim 46 at their closest point and are approximately 36" apart at their distal ends which defines the second pair of net attachment locations.

The left side net 48 and the right side net 50 are attached to one another and closed at the rear side of the basketball rim 46 by a fabric panel 60. This fabric panel 60 replaces the backboard of a conventional basketball rim and backboard arrangement. The fabric is lighter than a backboard and the fabric is collapsible whereby the panel may be collapsed upon itself in the storage position to take up very little space.

The side net support arms 52 are attached close to one another at one end to the upright support 14. They are pivotably attached to the upright support, whereby their remote distal ends defining the first pair of net attachment locations may be spread apart from one another to stretch out and define the back fabric panel 60. In a preferred embodiment, the first pair of net attachment locations 56 are 36" apart.

Attached to the base of the fabric panel and to the base of the left and right side nets is the chute 62. The chute 62 is attached at its proximal end to the fabric panel 60 and to left and right side net 48, 50. The chute extends from its attachment at the fabric panel 60 to the distal chute attachment bar 18, whereby the chute and the netting are pulled relatively taut. The chute preferably is made of fabric and is attached along the length of the bottom side of the left and right side nets 48, 50.

As now can be fully understood, when a basketball player stands at distal chute attachment bar 18 and looks towards the basketball rim 46, the player has a clear line-of-sight to the basketball rim 46. The player also is looking at the front sides of the panels defining the left side net 48 and the right side net 50. Those panels are closer together at their bottom ends than at their top ends, defining a trapezoidal opening. When the player shoots a basketball towards the rim, then, whether or not the ball goes through the hoop, the net/chute assembly collects the ball and channels it back to the player via the chute.

The basketball rim 46 includes a net 64 and a plate 65. The plate 65 is attached directly to the upper portion 44 of the upright support 14. When the upright support 44 is extended or lowered telescopically on the lower portion 42, the basketball rim 46 moves up and down with the upper portion 44. The basketball rim could be attached to and move with the net/chute assembly, although it is fixed on the upper portion 44 in the preferred embodiment.

The net/chute assembly 20 can be moved up and down upon the upper portion 44 by sliding engagement with the upper portion 44, described in greater detail below. This is possible because any one of or combination of the rear fabric panel 60, the left side and right side nets 48, 50 and the chute 62 define an opening 66 through which the upper portion 44 passes slidably. In this manner, the net/chute assembly 20 can be raised upon the upper portion or lowered upon the upper portion without having the net/chute assembly 20 get caught upon or have interference with the rim 46 which projects from the upper portion 44 of the upright support 14.

As can be seen with reference to FIG. 1, the left side net 48 and the right side net 50 can be described as collapsible walls consisting of wedged-shaped panels defined by fabric 69 sewn onto and defining borders of the netting. The fabric 69 also can be sewn to define longitudinal openings for receiving the side net support arms 52 and front net support arms 54 in sleeve-type arrangements. Thus, a substantially wedge-shaped segment of netting is formed between the rear fabric panel 60 and the front net support arms 54. A relatively larger panel of netting, substantially wedge-shaped, is formed between the front net support arms 54 and the chute 62. These wedge-shaped panels can be collapsed upon themselves when the front support arms 54 are pivoted into planer alignment with the side net support arms 52 and when the chute 62 is detached from the distal chute attachment bar 18 and rolled and positioned against the upper portion 44 of the upright support 14. This collapsed position is described and shown in FIG. 2 below.

In the description herein, the right side netting and left side netting are sometimes described as panels. These panels, although slightly angled towards one another at their bottom front section in a preferred embodiment, can be seen as extending substantially vertically. The left side netting and right side netting define collapsible walls. A collapsible wall is a netting or fabric, typically. It also could be a plastic that can fold or collapse as a fabric. Virtually any material that can in an expanded position define a substantially planer wall and that can in a collapsed position fold, roll or otherwise compress into a relatively compact space is embraced. Thus, the rear fabric panel 60 can be any sort of collapsible wall. It is preferred that this panel be a fabric panel, whereby it gives the player an appearance of a solid backboard, but does not have the weight of a solid backboard. This rear fabric panel 60 also could be configured out of foldable material, such as jointed solid material, provided that this rear panel can be collapsed upon itself into a relatively compact space.

As will be described in more detail below, the side net support arms 52 and front net support arms 54 are pivotably attached to the upright support. As used herein, pivotable means attached directly at a pivot joint, attached indirectly with a linker having a pivot joint, attached indirectly by fabric which holds adjacent ends together or near one another, or attached indirectly by netting, rope or the like which holds adjacent ends near one another. The ends also can be carried on hubs with interlocking teeth, which hubs can rotate and be positioned and secured in various arrangements with respect to one another. Virtually any arrangement that holds two ends together or close to one another while permitting the opposite ends to move over a substantially greater distance is a pivot joint as used herein.

As can be seen from FIG. 1 and is described in greater detail below, the pivotable movement of the front net support arms 54 with respect to the upright support is initiated by simple gravitational forces and is limited by collapsible material. In the embodiment shown, the collapsible material is the fabric 69 sewn to the netting and defining the borders of the netting. In this manner, the fabric which extends between the first net attachment location 56 and the second net attachment 58 limits further pivotable forward motion of the front net support arms 54. The collapsible material can be fabric as depicted, but also could be rope, string, plastic and the like. In this embodiment, a mechanical locking inter-engagement of the front support arms with the upright support is not needed. As mentioned above, mechanical locking means for securing the front net support arms 54 also, however, can be used to position the front support arms relative to this side support arms.

Figure 4:
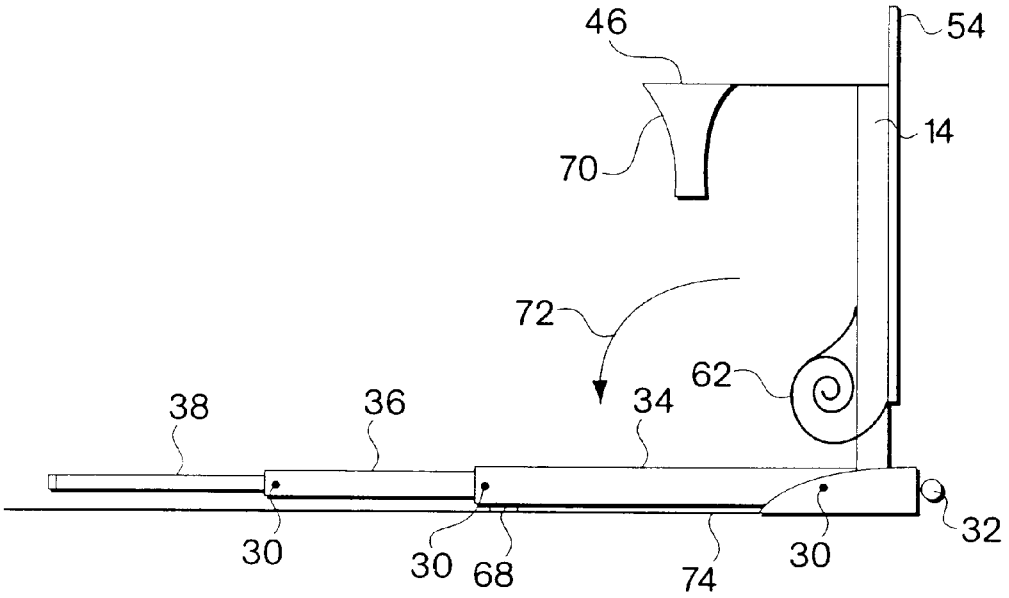
FIG. 4 is a schematic view of the basketball retrieval device of FIG. 2 in a second-step configuration for assembling the device into the use position.
Figure 5:
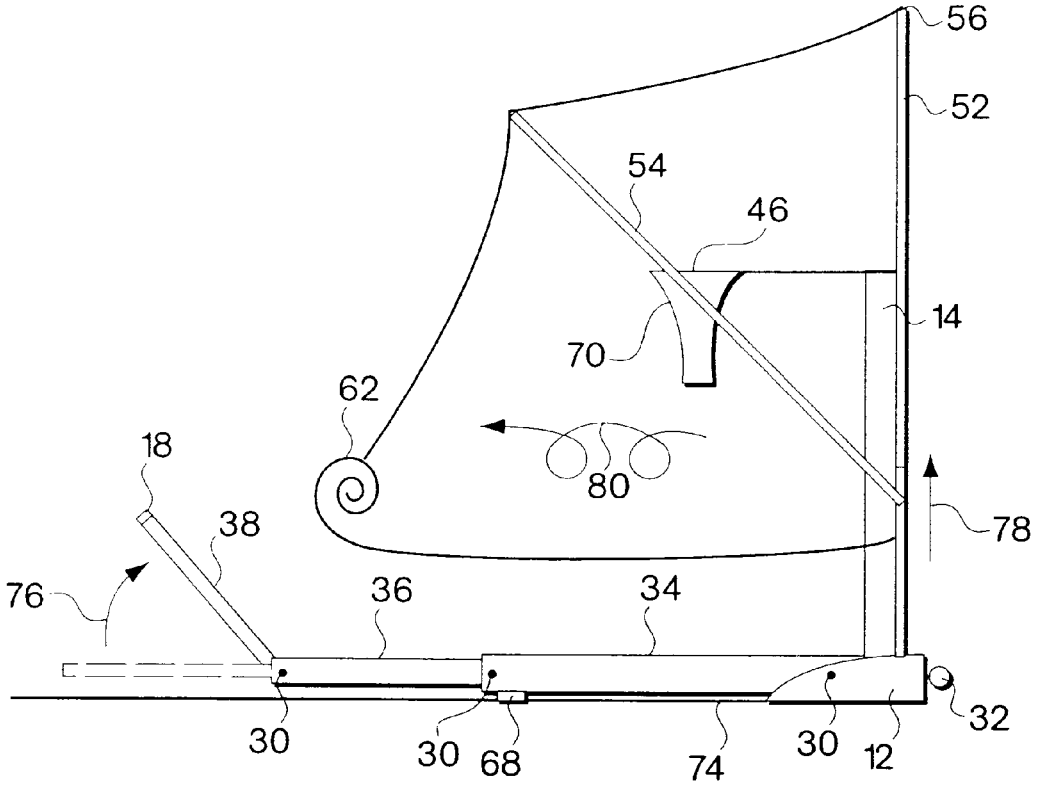
FIG. 5 is a schematic view of the basketball retrieval device of FIG. 2 in a third-step configuration for assembling the device into the use position.
Figure 6:
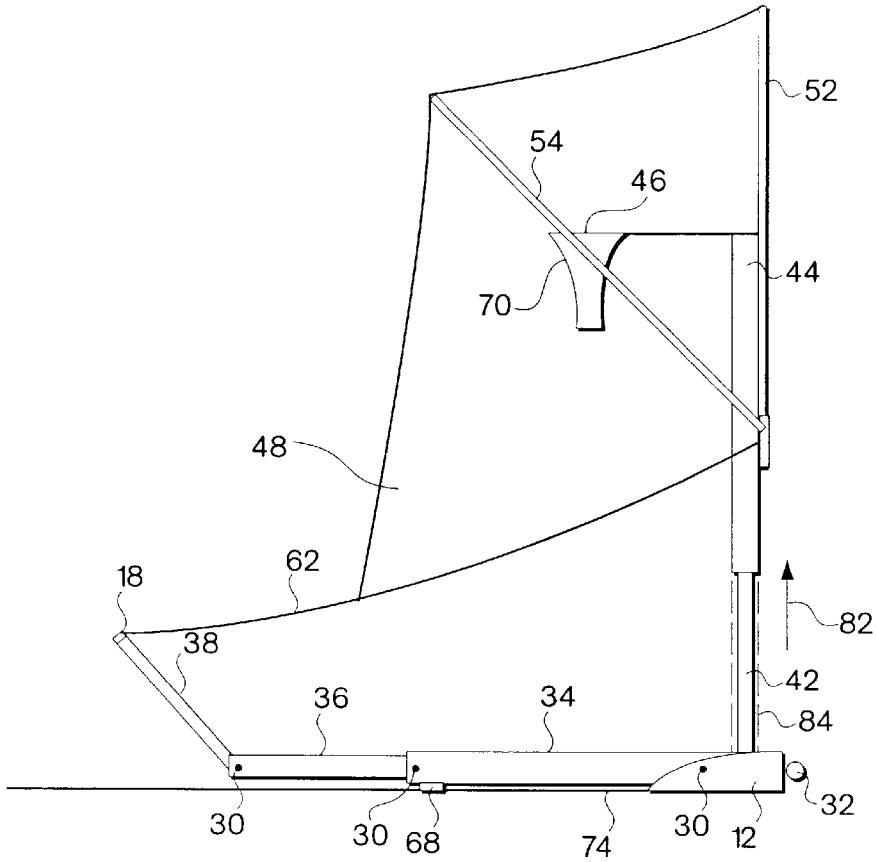
FIG. 6 is a schematic view of the basketball retrieval device of FIG. 2 in the use position.

FIGS. 2–6 depict the assembly of the basketball retrieval device of FIG. 1 from the storage position (as shown in FIG. 2), through several configurations during the method of unfolding the device, into the use position (as shown in FIG. 6). Referring to FIG. 2, the basketball retrieval device 10 is shown in the storage position with the upright support 14, distal chute support 16, side net support arms 52 and front net support arms 54 in an upright position, vertically-oriented. The right side net 50 is collapsed and the chute 62 is rolled from its distal end to its proximal end, being held between the distal chute support 16 and the upright support 14. The distal chute support 16 is positioned between the basketball net 70 and the upright support 14.

Figure 3:
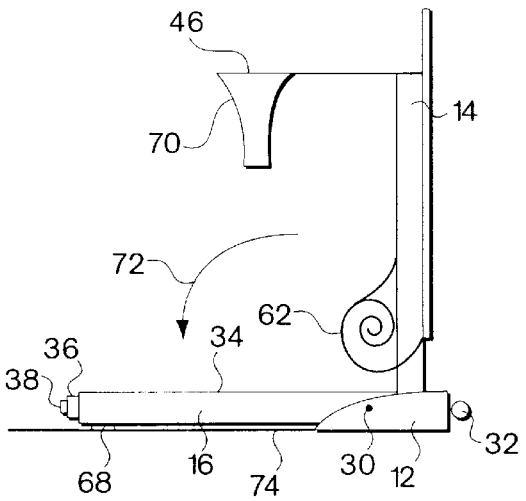
FIG. 3 is a schematic view of the basketball retrieval device of FIG. 2 in a first-step configuration for assembling the device into the use position.

FIG. 3 depicts a first-step configuration for assembling the device into the use position. The distal chute support 16 is pivoted downwardly in the direction of arrow 72 until the first section 34 rests on a flat playing surface 74 via pad 68. Then, as shown in FIG. 4, the second section 36 and third section 38 of the distal chute support 16 are telescopically extended from the first section 34.

In a next step depicted in FIG. 5, the third section 38 is pivoted upwardly in the direction of arrow 76 and locked via a locking pin (not shown) in the use position, with the distal chute attachment bar 18 positioned approximately 36" above the flat playing surface 74. In addition, the net/chute assembly 20 is slid upwardly along the upright support 14 (along upper portion 44) in the direction of arrow 78 to place the net/chute assembly 20 at the desired position above the basketball rim 46. Simultaneously, the chute 62 is permitted to unroll as depicted by arrow 80 which causes front net support arms 54 to pivot from alignment with the plane defined by the side net support arms 52 to a position where the front net support arms extend frontwardly and above the basketball rim 46. The side net support arms 52 are spread apart at their top ends. In this position, the side net support arms 52 define the first pair of net attachment locations 56 at the rear of the basketball rim 46 and above the basketball rim, while the front net support arms 54 define the second pair of net attachment locations which are forward and above the basketball rim 46.

FIG. 6 depicts the final step in assembling the device into the use position. The upper portion 44 of the upright support 14 is extended telescopically from the lower portion 42, in the direction of arrow 82 to position the basketball rim 46 10' above the flat playing surface 74. The position of the upper portion 44 just prior to extending it along the lower portion 42 is depicted by the phantom lines 84, which lines show the position of the upper portion 44 as in FIG. 5. Chute 62 then is attached to the distal chute attachment bar 18, in the preferred embodiment by hooks on the chute and rings on the chute attachment bar. The device then is ready for use.

Figure 7:
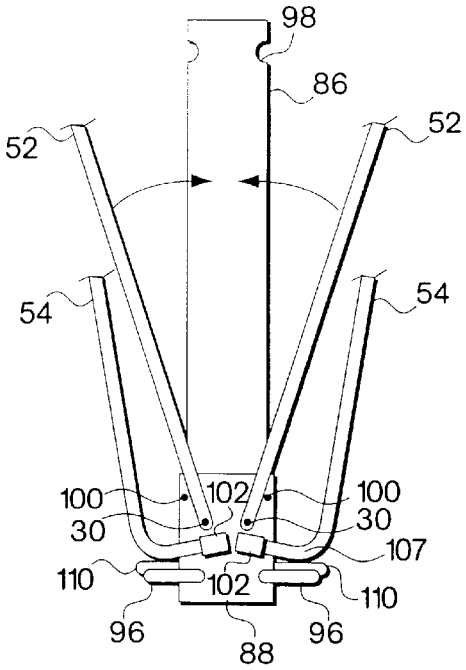
FIG. 7 is a partial rear view of the net support assembly and upright support runner of the device of FIG. 1.

FIG. 7 depicts those features of the device of FIG. 1 which permit the net/chute assembly 20 to slide upon the upper portion 44 of the upright support 14. The upper portion 44 of the upright support 14 has attached to it a thin elongated plate which acts as an upright support runner 86. Slidably attached to this upright support runner 86 is net/chute assembly attachment plate 88. The inter-engagement of the attachment plate 88 upright support runner 86 and upper portion 44 can be seen in more detail in the schematic cross-section depicted in FIG. 9.

Figure 9:
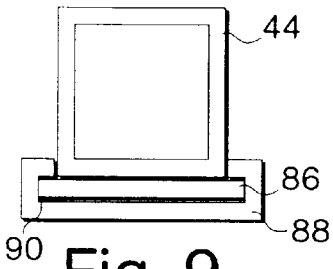
FIG. 9 is a partial schematic cross-sectional view of the net support assembly plate and upright support of the device of FIG. 1.

FIG. 9 shows the upper portion 44 which is a hollow, square segment of aluminum. The upright support runner 86 is welded to the upper portion 44 and extends substantially along the length of the upper portion 44. The upper support runner 86 is slightly wider than the width of the upper portion 44, to create a ridge which extends on either side of the upper portion 44 substantially along the length of the upper portion 44. This ridge 90 is for inter-engagement with the attachment plate 88. The attachment plate 88 is a substantially square aluminum plate with U-shaped ends which extend beyond and around ridges 90, to hold the attachment plate 88 in slidable engagement with the upright support runner 86.

Figure 10:
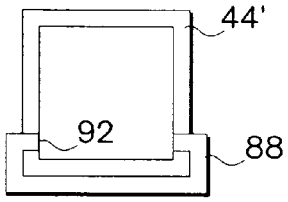
FIG. 10 is a partial schematic cross-sectional view of a net support assembly plate and upright support according to another embodiment.
Figure 11:
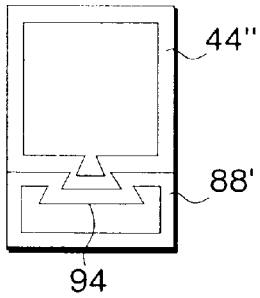
FIG. 11 is a partial schematic cross-sectional view of a net support assembly plate and upright support according to yet another embodiment.

It should be understood that the invention is not intended to be limited in any respect by the manner in which the net/chute assembly 20 is slidably attached to the upright portion 14. As further examples, FIG. 10 depicts a schematic cross-section in which the attachment plate 80 is configured to inter-engage with grooves or openings 92 in the upper portion 44' for slidable engagement of the attachment plate 88 with the upper portion 44'. In this arrangement, the upright support runner 86 is eliminated. Likewise, as shown in schematic cross-section in FIG. 11, the attachment plate 88' can inter-engage the upper portion 44" by a dove-tail slidable joint 94. It is even possible that the net/chute assembly 20 be attached to the upper portion 44 of the upright support other than by a slidable arrangement. More important, according to the invention, is that the net/chute assembly can be moved (even removed) from the use position in which it is positioned at the upper end of the upper portion 44 of the upright support 14 so that the device can be placed into a storage position. When the net/chute assembly 20 is positioned at the upper portion of the upright support 44, then the combined length of the net/chute assembly and upper portion 44 of the upright support 14 is more than 7', which does not permit easy storage.

Referring again to FIG. 7 which depicts a preferred embodiment, the attachment plate 88 is slidably attached to the upright support runner 86. A pair of locking arms 96 carry locking pins (not shown) for engaging notches 98 in the ridges 90 of the upright support runner 86. When the locking pins are engaged with the notches 98, vertical movement of the attachment plate 88 along the upright support runner 86 is prevented, thereby locking or securing the attachment plate 88 in a desired position along the upright support runner 86. Such locking engagement is important when the net/chute assembly is positioned in the use position. In the storage position, gravity will hold the net/chute position in place, and it is necessary simply to have a ridge, pin, or other means associated with the upright support for limiting further downward movement of the net/chute assembly on the upright support runner 86.

Again referring to FIG. 7, the side support arms 52 are shown in the use position. The side support arms are attached at their bottom end to the attachment plate 88 by pivot pins 30. In the use position, the ends of the side net support arms 52 remote from the plate are spread apart from one another, limited in their ability to pivot apart from one another by stop pins 100 attached to the plate. The arms also could be limited only by the fabric sleeves of the rear panel into which the side net support arms extend. Likewise, the side net support arms 52 can be attached to the attachment plate 88 by hub arrangements, for example with interlocking teeth, permitting the arms to be selectively positioned in a use and a storage position. The manner in which the pivotable movement of the side net support arms 52 is limited is not critical. As can be seen, the side net support arms 52 pivot within and define a plane which extends vertically, parallel to the upright support 14 and orthogonal to the center plane defined by the player and the upright support when the player is at the distal chute attachment bar facing the rim.

The front net support arms 54 also are pivotably attached to the plate. The front net support arms 54 are received in tubes 102 which are welded to the attachment plate 88. The tubes 102 define hollow channels for receiving the tubular front support arms 54.

Figure 8:
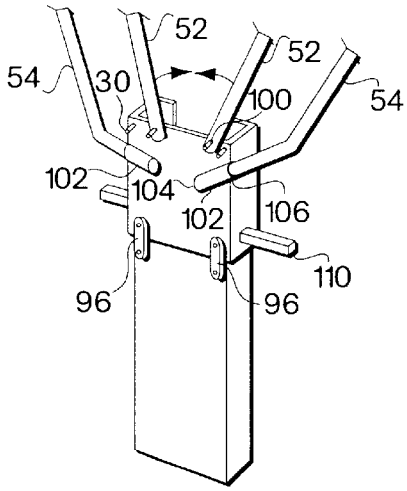
FIG. 8 is a partial perspective view of the net support assembly and upright support of the device of FIG. 1.

The orientation of the tubes 102 on the attachment plate 88 is depicted in a perspective view in FIG. 8. The tubes 102 are welded at an angle with respect to the plane defined by the attachment plate 88. The base 104 of the tubes is closer to the plane defined by the plate than the open end 106 of the tubes. This arrangement provides a unique aspect of the invention. When the front net support arms 54 are rotated into the plane defined by the side net support arms 52, the distal ends of the front net support arms are brought close together. When the front net support arms 54, however, are pivoted to the use position with the front net support arms extending frontwardly and upwardly of the rim, the distal ends of the front net support arms are placed between 3' and 4' apart from one another. In this manner, the front net support arms 54 can be brought into a compact arrangement in the storage position and opened into the use position which is not so compact. It is the combination of the angled arrangement of the tubes 102 and the bend toward the base of the front net support arms 54 which permits this unique arrangement. This arrangement also permits the front net support arms 54 to extend past the basketball rim 46 at the desired spacing from the basketball rim 46. This arrangement further permits the formation of a substantially flat rear fabric panel, which is secured along the length of the side net support arms 52 but which is also secured to the front net support arms at the base 107 of the front net support arms, the base of each front support arm being substantially at the plane defined by the side net support arms when the front net support arms are positioned in the use position.

Figure 12:
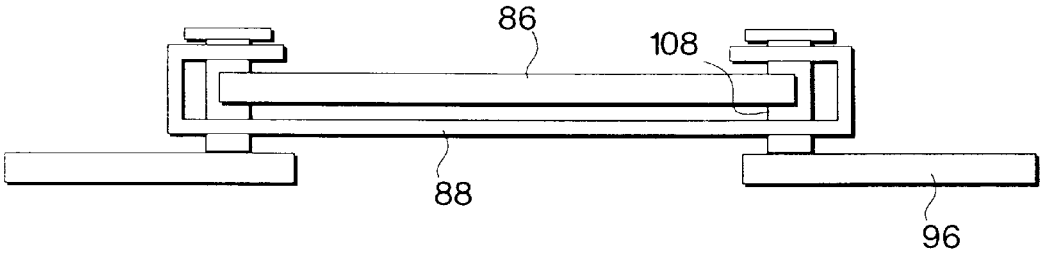
FIG. 12 is a partial schematic cross-sectional view of the net support plate and upright support runner of the device of FIG. 1.
Figure 13A:
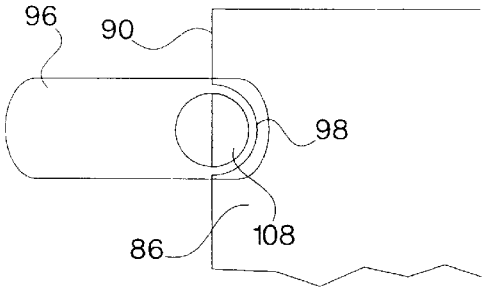
FIG. 13 is a schematic rear view of the locking assembly between the pins and upright support runner of the device of FIG. 1.
Figure 13B:
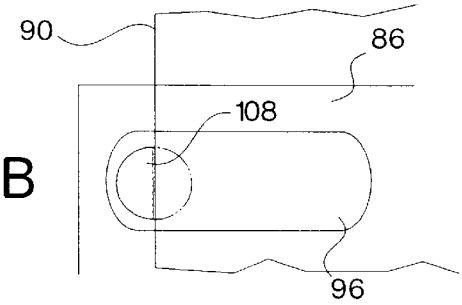

FIG. 12 is a cross-sectional depiction of the inter-engagement of the attachment plate 88 to the upright support runner 86, with the locking arms 96 positioning the locking pins 108 in inter-engagement with the notches 98. Referring to FIG. 13, it can be seen that when a locking arm 96 is rotated such that they extend laterally outwardly from the attachment plate 88, the half-round locking pins 108 are brought into inter-engagement with the notches 98, thereby limiting movement of the attachment plate 88 on the upright support runner 86. This is depicted in the configuration shown in FIG. 13A. As shown in the configuration of FIG. 13B, when the locking arm 96 is rotated 180°, the half-round locking pin 108 likewise is rotated 180°, aligning the flat side of the half-round locking pin parallel and beyond the edge of the ridge 90 of the upright support runner 86. In this manner, the half-round locking pin is free from engagement with the upright support runner 86 and the attachment plate may slide up and down along the upright support runner 86.

A pair of handles 110 extends laterally from either side of the attachment plate 88, which handles can be gripped to lift the net/chute assembly 20 slidably along the upright support runner 86 (FIGS. 7 and 8). The proximal end of the handles 110 is placed adjacent to the locking arms 96, whereby the fingers may grip handles 110 and the thumbs may grasp locking arms 96 to place the locking pins 108 in locking position by rotating the locking arms 96 with the thumbs when the net/chute assembly 20 is lifted to the appropriate position.

Figure 14:
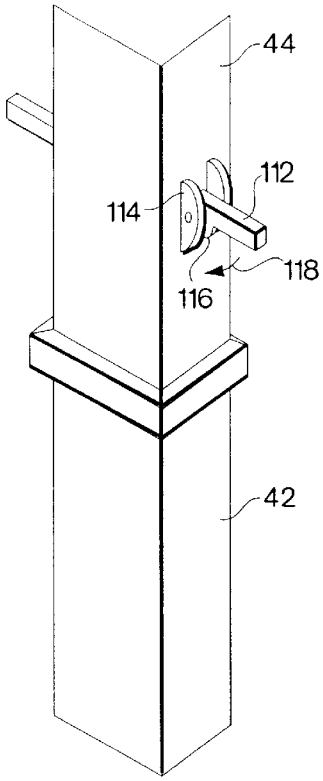
FIG. 14 is a perspective view of the lower upright support and upper upright support of the device of FIG. 1.

Referring now to FIG. 14, the upper portion 44 of the upright support is provided at the lower end thereof with a pair of cam handles 112. The cam handles 112 are pivotably attached to the upper portion 44 of the upright support 14 by a pair of cam handle plates. When the cam handles 112 extend laterally from the upper portion 44, the cam 116 is brought out of engagement with the lower portion 42, permitting the upper portion to slide telescopically with respect to the lower portion. When the cam handles 112 are rotated downwardly in the direction of arrow 118, the cams are brought into engagement with the lower portion 42 via openings (not shown) in the upper portion 44 adjacent the cam to lock the upper portion with respect to the lower portion. In the preferred arrangement, the cams are self-locking when the upper portion 44 moves downwardly with respect to the lower portion 42. In particular, the weight of the cam handles 112 causes the handles to rotate slightly downwardly, thereby causing the cams to engage the lower portion. Further downward movement of the upper portion causes further rotation and locking engagement of the cam 116 to the lower portion 42.

Figure 15:
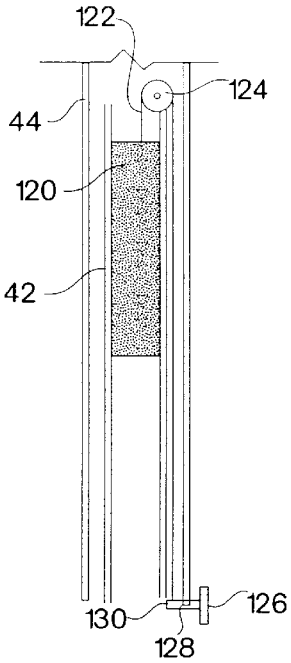
FIG. 15 is a schematic cross-sectional view of the upper and lower upright supports of the device of FIG. 1, showing the counterweight assembly in the storage position.
Figure 16:
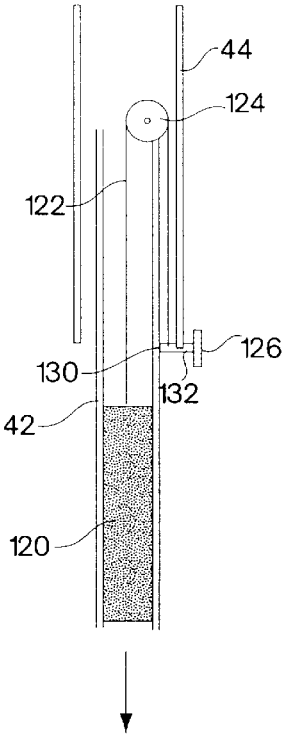
FIG. 16 is a schematic cross-sectional view of the upper and lower upright supports of the device of FIG. 1, showing the counterweight assembly in the use position.

Because of the weight of the upper portion and net/chute assembly, the preferred embodiment has been provided with a counter-weight assembly to permit the easy movement of the upper section 44 and net/chute assembly 20 with respect to the lower section 42. The counter-weight also is provided to add safety, preventing the upper portion from moving downwardly very quickly with respect to the lower portion due to gravity. Referring to FIG. 15, a schematic partial cross-section of the device in the storage position is shown. A counter-weight 120 within lower portion 42 is attached to a cable 122. The cable 122 extends from the counter-weight 120 around a pulley wheel 124 attached at the upper end of the lower portion 42, whereby the cable 122 may extend from the counter-weight within the hollow of the lower portion 42 above and around the pulley wheel 124 to the space between the telescoping arrangement of the lower portion 42 and upper portion 44. The distal end of the cable 122 remote from the counter-weight 120 is attached to the lower end of the upper portion 44, on the inside of the upper portion between the upper portion 44 and lower portion 42. When the upper portion 44 is moved upwardly with respect to the lower portion 42, as depicted in FIG. 16, the counter-weight 120 drops within the hollow of the lower portion 42 and assists in the movement of the upper portion 44 with respect to the lower portion 42.

A locking knob 126 is attached to the upper portion 44 for locking the upper portion 44 with respect to the lower portion 42. The locking knob 126 has a shaft which extends through a threaded opening 128 in the upper portion 44. The distal end 130 of the threaded shaft 132 of the locking knob 126 then can contact the lower portion (or may extend through an opening in the lower portion) to secure the upper portion 42 with respect to the lower portion 44. An opening in the lower portion as just mentioned, or other locating means such as a stop pin, a groove, and the like, can be provided so that the position of the upper portion can be located with respect to the lower portion whereby the rim can be positioned 10' above the flat surface upon which the base rests.

In the preferred embodiment, the first section 34, second section 36, third section 38, lower portion 42 and upper portion 44 are hollow, square, aluminum tubes. The first section 34 is 72" long and has a wall thickness of about 0.125". The second section 36 is 72" long and has a wall thickness of about 0.125". The third section is 60" long and has a wall thickness of about 0.125". The lower portion 42 is 72" long and has a wall thickness of 0.25". The upper portion 44 is 72" long and has a wall thickness of about 0.125". The side net support arms 52 are straight aluminum tubing, 50" in length and having a wall thickness of about 0.1". The front support arms 54 are made of the same aluminum tubing. They are 85" long and are bent over an angle of 100°, the radius spread over the region 12" from the base of the aluminum tube to 18" from the base of the aluminum tube. The front support arms are angled from the plane defined by the surface of the attachment plate 8° outwardly and 11° downwardly from horizontal. The side net support arms 52 are spread apart at their distal ends 36" and the front net support arms 54 are spread apart at their distal ends 36". The top edge of the netting between the first net attachment locations and the second net attachment locations is placed 32" above the horizontal plane defined by the rim. The distal ends of the front net support arms 54 extend 4'4" forward of the rear panel (25" forward of the front-most point on the rim). The chute 62 is positioned at the upright support 44 20" below the horizontal plane defined by the basketball rim. The netting is attached to the chute at its front-most portion (defined by the acute angle at the junction of the top side and the bottom side) about 7' along the chute from the upright support. The chute is about 28" in width (stretched in a plane) defining a chute about 22" wide. In a most preferred embodiment, a shock-absorbing pad (not shown) made of foam rubber is placed between the rim attachment plate 65 and the upper portion 44 of the upright support. This shock-absorbing pad makes the rim less rigid when a basketball falls upon the rim, causing the ball to bounce less after it strikes the rim. Because the 'rebound' bounce of the ball is reduced, the netting does not have to be as high above the plane defined by the rim as it otherwise would need to be in order to capture balls bouncing off of the rim.

Figure 17:
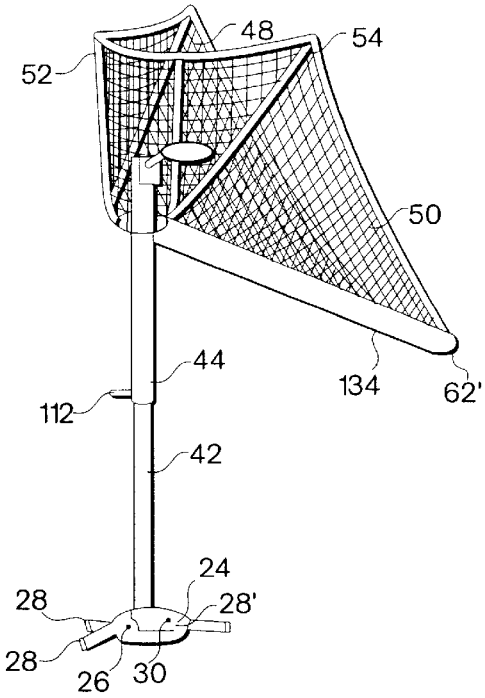
FIG. 17 is a perspective view of a basketball retrieval device according to another embodiment of the invention, in the use position.

FIG. 17 depicts another embodiment of the invention. In this embodiment, the device is the same as that shown in FIG. 1, except that the distal chute support which extends horizontally from the base has been eliminated and the chute is relatively truncated. The distal chute attachment bar also has been eliminated, whereby the ball is free to exit the chute and bounce toward the player. This embodiment also includes an upright support 14 with a lower portion 42 telescopically extending vertically and inter-engaging with an upper portion 44. The device also has a base 12 with balancing legs 28 pivotably attached to leg brackets 26. Instead of a distal chute support as shown in FIG. 1, this device has a third balancing leg 28' which is pivotably attached to support brackets 24 by pivot pin 30. The balancing legs 28 and balancing leg 28' form a tripod for supporting the base on a flat surface.

The chute 62' ends at the point where the lower front of the net from the left side netting and the right side netting meet the chute. In this manner, gravity can support the chute 62', whereby the chute simply hangs from the bottom edge of the netting arrangement. This embodiment may be modified, as shown, to include a pair of chute support arms 134 which define the border between the bottom edge of the panels of netting and the chute 62'. In the embodiment shown, these chute support arms are depicted as pivotally attached to the attachment plate 88, in a manner similar to the attachment of the front support arms 54 to the plate.

The chute support arms 134 need not be angled at their position of attachment to the attachment plate 88 (as with front support arms 54). The distance between the chute support arms at their proximal and distal ends can be the same. It should be recognized, however, that an angled orientation such as with the front support arm attachment configuration could be provided to create positioning of the distal ends of the chute support arms 134 in the storage position and the use position as desired. It also should be noted that the chute support arms 134 need not be attached to the attachment plate 88 proximal to the front net support arms 54. The attachment plate can be elongated and the chute support arms 134 can be attached at a position spaced from the attachment positions of the front net support arms. In addition, the chute support arms need not be attached to the attachment plate at all. The chute support arms 134 simply may be carried in fabric sleeves at the juncture between the chute and the netting, whereby the pivotal attachment of the chute support arms 134 with respect to the upright support is provided simply through an indirect pivot joint created by the fabric itself. The chute support arms 134 also could pivot from the front net support arms 54. The weight of the chute particularly in the presence of chute support arms, is sufficient to position the chute in the desired downward sloping angle.

Figure 18:
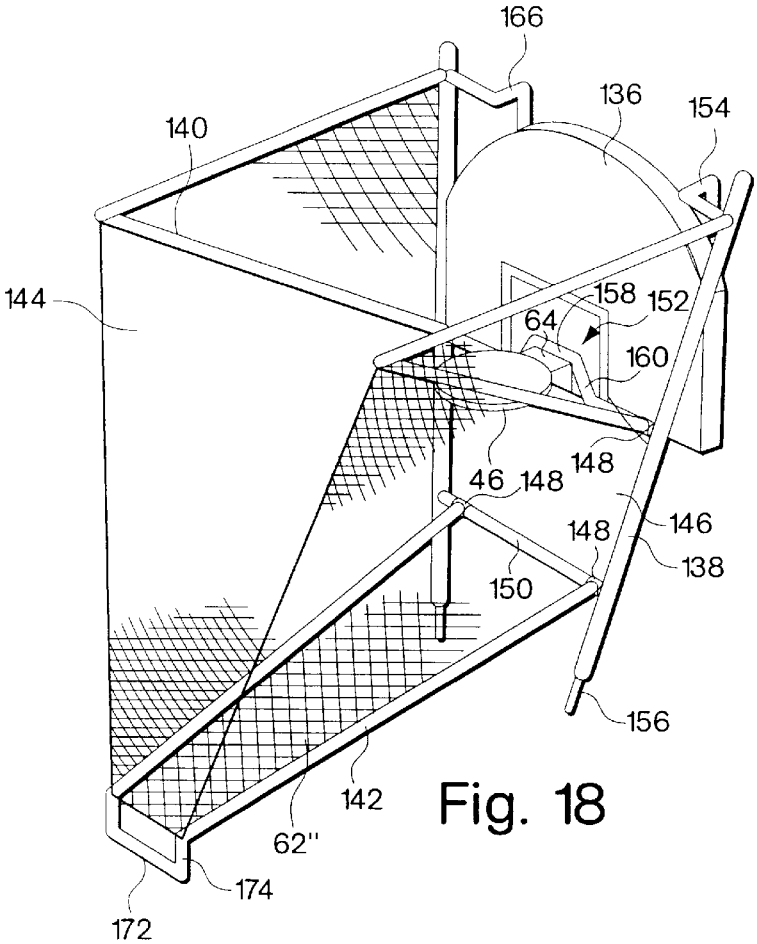
FIG. 18 is a perspective view of a basketball retrieval device according to another embodiment of the invention, in the use position.

FIG. 18 depicts another embodiment of the invention. This embodiment is not free-standing, but rather is adapted to be supported on an existing basketball backboard and rim assembly. The device comprises a frame for attachment to the backboard/rim assembly, a pair of panels of netting for capturing a ball bouncing off of the rim and a chute 62" for channeling the ball in a direction back toward the player. The device in FIG. 18 is depicted attached to a backboard 136. The device has a pair of upright arms 138 which are spaced together closer at the bottom than at the top. These arms 138 lie flush against the face of the backboard 136. The top ends of these upright arms are positioned above the horizonal plane defined by the basketball rim and the lower ends of these upright arms 138 are positioned below the horizontal plane defined by the basketball rim. These upright arms define rear walls to which netting is attached. The netting is attached substantially along the length of these upright arms 138. Approximately at the mid-point of these upright arms is a pair of front support arms 140 extending upwardly and frontwardly of the basketball rim to define net attachment locations above and in front of the basketball rim. These front support arms 140 are pivotally attached to the frame, whereby they can be pivoted from a storage position in which they are aligned substantially parallel to the upright arms 138 and the use position depicted in FIG. 18 in which they extend upwardly and frontwardly of the upright arms 138.

Chute support arms 142 also are pivotally attached to the frame, near the bottom end of the upright arms 138. The chute support arms extend frontwardly and downwardly with respect to the horizontal plane defined by the basketball rim to define the distal end of the chute 62". The chute support arms also are pivotable from the use position depicted in FIG. 18 to a storage position in which they are aligned substantially parallel to the plane defined by the upright arms. Netting is attached to the arms and the chute to define a left side panel 144 of netting and a right side panel 146 of netting. The netting is substantially in the shape of a trapezoid comprising: a vertical side extending parallel to the plane adjacent the backboard, a top side position at least 12" above the rim along its length and substantially parallel to the horizontal plane defined by the rim, a front side longer than the top side and extending from the top side downwardly and forming with the top side in an obtuse angle, and the bottom side extending downwardly from the vertical side to the front side and forming with the front side an acute angle. The panels are positioned closer together at the acute angle where the netting meets the chute than at the obtuse angle which is located at the distal ends of the front support arms 140.

The front support arms 140 and chute support arms 142 are pivotally attached to the frame by pivoting T connections 148 located on cross-bars which connect the upright arms 138. The upright arms are connected by three cross-bars, a lower cross-bar 150, a middle cross-bar 152 and an upper cross-bar 154. The lower cross-bar 150 carries the chute support arms 142 while the middle cross-bar 152 carries the front support arms 140.

The configuration of the middle cross-bar 152 and upper cross-bar 154 permits the frame to be attached easily to a basketball backboard/rim arrangement. The middle cross-bar has a U-shaped section at its center, with the opening face of the U facing downwardly. Thus, this U-shaped midsection has a substantially horizontal section 158 and a pair of downwardly extending sections 160. The horizontal section 158 is at least as wide as the neck 64 of the basketball rim and is adapted to rest on the neck 64 of the basketball rim. The downwardly extending sections 160 act as stops to restrict lateral movement of the frame on the neck of the basketball rim and to locate the horizontal section 158 on the neck 64 of the rim. The downwardly extending sections 160 are angled outwardly (spaced further apart at the ends remote from the horizontal section 158) which assists in locating the horizontal section 158 on the neck 64 of the rim.

The upper cross-bar 154 also has a U-shaped section, with the opening of the U facing upwardly. Thus, the upper cross-bar 154 has a horizontal section 162 and a pair of upwardly extending sections 164 defining the U-shaped portion of the upper cross-bar 154. The U-shaped section of the upper cross-bar is placed behind the plane defined by upright arms 138, being spaced therefrom by orthogonal segments 166. The orthogonal segments 166 extend from the upper cross-bar 154 rearwardly and substantially orthogonally to the plane defined by the upright arms 138. The orthogonal segments 166 form with the upwardly extending sections 164 L-shaped segments for engaging the rear side of the backboard 136.

The lower cross-bar 150 and the middle cross-bar 152 are spaced apart from one another sufficient to allow the basketball rim to be passed there-between. In addition, they are spaced far enough from one another whereby when the lower cross-bar 150 is lifted toward the horizontal plane defined by the basketball rim, the horizontal section 162 of the upper cross-bar 154 can pass over the top of the backboard. The device then can be moved downwardly until the horizontal section 158 of the middle cross-bar 152 contacts the neck 64 of the basketball rim 46, positioning the horizontal section 162 and upwardly extending sections 164 of the upper cross-bar against the rear of the basketball backboard. The gravitational forces supplied by the weight of the chute support arms 142, front support arms 140 and netting pulls the horizontal section 162 and upwardly extending sections 164 against the back of the backboard 136.

Figure 19:
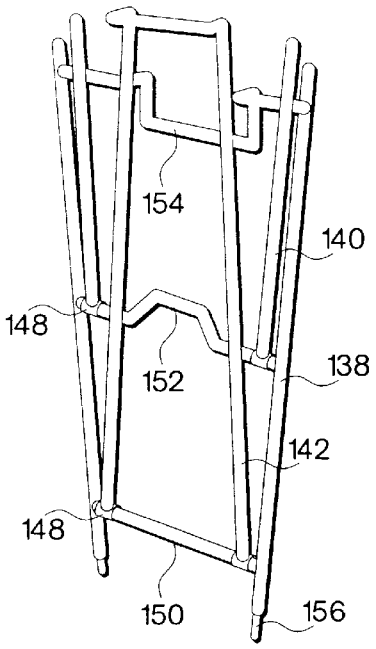
FIG. 19 is a perspective view of the frame of the device of FIG. 18, in the storage position.
Figure 20:
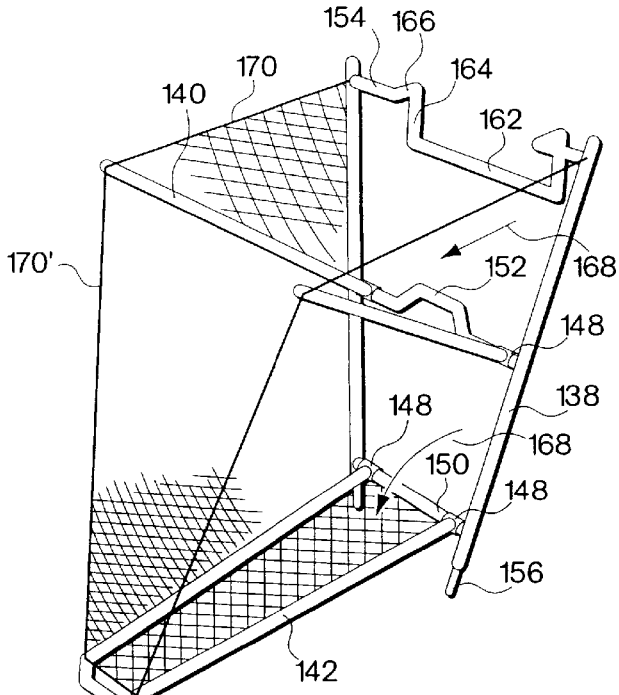
FIG. 20 is a perspective view of the frame of the device of FIG. 18, in the use position.

The frame of the device of FIG. 18 is depicted in a collapsed position in FIG. 19. As can be seen, the upright arms 138, front support arms 140 and chute support arms 142 are brought into planes substantially parallel with one another. To move the frame into the use position, the chute support arms 142 and the front support arms 140 are pivoted outwardly and downwardly from their planer arrangement into the use position. This movement is depicted by arrows 168 in FIG. 20.

The movement of the front support arms 140 relative to the upright support arms 138 is limited by collapsible material 170. This collapsible material can be string, twine, rope, netting, fabric and the like. In the preferred embodiment, the collapsible material 170 is the fabric border sewn to the netting. Likewise, the downward pivotable movement of the chute support arms 142 relative to the front support arms and upright arms is limited by the attachment of collapsible material 170' attached between the front support arms 140 and the chute support arms 142.

As mentioned above, pivotable movement of the arms relative to the frame can be achieved in a variety of ways. The embodiment depicted in FIG. 18 is not intended to be limited by the particular mechanisms described. Instead, any manner of pivotal attachment as well as pivot-limiting means can be employed. Thus, pivot joints including fabric pivot joints as described above are suitable and mechanical pivotable joints such as hubs with interlocking teeth for securing the arms with respect to one another also can be employed. Further, in the embodiment depicted, the chute support arms 142 can be eliminated. The weight of the netting and chute (which itself can be formed of netting) can be sufficient to define the side panels and channel the ball back to the player. In the embodiment shown, however, the chute is provided with chute support arms which helps define the chute and assists in channeling the ball back to the player.

As shown in the various figures, the distal end of the chute support arms can be connected by a U-shaped member having a horizontal section 172 and two upwardly extending arms 174. This U-shaped section stabilizes the distal ends of the chute support arms and further brings the horizontal section 172 outside of the plane defined by the chute so that a ball traveling along the chute does not contact the horizontal section 122 which would slow or alter the return of the ball to the player.

Figure 21:
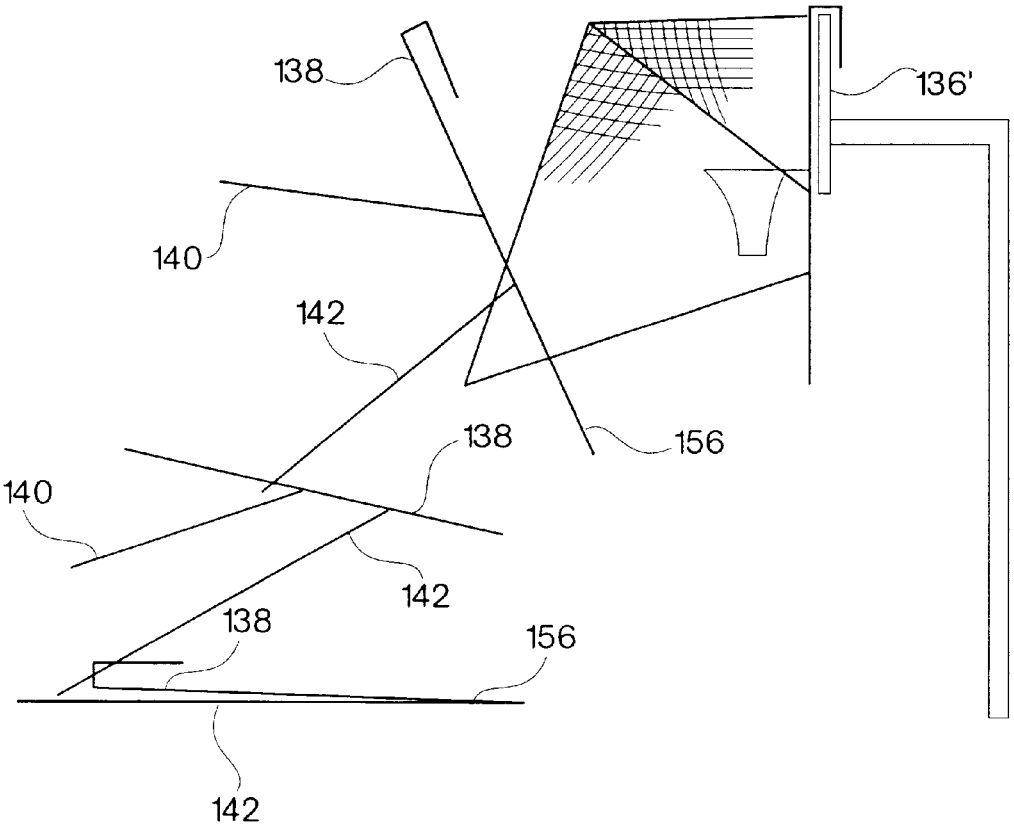
FIG. 21 is a schematic view of the method for assembling the device of FIG. 18 onto a backboard and rim assembly.

The method of assembling the device is depicted schematically in FIG. 21. The device is placed on the ground, with the upright arms 138 on top. The retractable lifting arms 156 which are telescoped within the upright arms are extended. This can be accomplished by simple quarter-turn locking arrangements as are common in extendable arms for reaching windows. The device is then lifted by a person grasping the extended lifting arms 156. As the upright arms are lifted and the top end of the upright arms 138 are brought towards a vertical position, gravity pulls the chute support arms 142 and the front support arms 140 out of their planer arrangement with the upright arms 138 and into their use position. The device is lifted onto the basketball rim, with the basketball rim passing between the lower cross-bar 150 and the middle cross-bar 152. The device is lifted whereby the horizontal section 162 of the upper cross-bar passes over the top of the backboard 136'. The device is then moved downwardly until the horizontal section 158 of the middle cross-bar rests on the neck of the basketball rim and until the horizontal section 162 of the upper cross-bar 154 is positioned behind the backboard. The retractable lifting arms then can be telescoped into the upright arms and the device is ready for use.

In the preferred embodiment, the various support arms and cross-bars are made of hollow aluminum tubing. The upright arms 138 are about 50" long and have a wall thickness of about 0.1". The front support arms are also 48" long and have a wall thickness of about 0.1". The chute support arms are 60" long and have a wall thickness of about 0.1". The retractable lifting arms 156 are 30" long and have a wall thickness of about 0.1". The locking means on the retractable lifting arms to lock the retractable lifting arms in telescoping position with the upright arms 138 or extended from the upright arms 138 are conventional and commercially available as boat hook or paint-roller devices. The lower cross-bar is 30" long and has a wall thickness of about 0.1". The middle cross-bar 152 is spaced 24" along upright arms 138 from the lower cross-bar 150, has a wall thickness of about 0.1". The upper cross-bar 154 is spaced from the middle cross-bar 152 along upright arms 138 24". The upper cross-bar has a wall thickness of about 0.1" and spaces the upright arms 138 from one another at the point of attachment to the upper cross-bar 154 by 48". The bends in the various cross-bars can be provided by bending the tubing or by welding pieces of tubing to one another.

It should be understood that the means for attaching the frame to a rim or to a basketball backboard is not limited to the embodiment depicted. In the embodiment depicted, this means comprises a cross-bar with stops for locating the frame on the neck of a rim. It also includes a pair of L-shaped arms for engaging a rear surface of the backboard. Innumerable structures, however, can be used to achieve the same purpose. The frame can be held on the backboard by brackets, clamps, screws, or other such attachment means. The frame also could be attached to mating structure prefabricated on or added to the backboard, such as mating male/female connectors, openings in the backboard for receiving projections on the frame (or vice versa), hooks on the backboard for engaging hook mating structures in the frame, interlocking tongue and groove arrangements on the backboard and frame, hook and loop arrangements on the backboard and frame, brackets on the frame for attachment to the neck of the rim, U-shaped members on the frame for attachment to the rim, and the like.

In addition, as used herein, means for supporting the frame with respect to the basketball rim includes means for attaching the frame only to a rim, only to a backboard or to both a rim and the backboard. It further includes upright supports as described herein such structures are described in the various prior art patents listed in the background of the invention, the disclosures of which are incorporated herein by reference. Virtually any upright supported on a base, tripod, platform, or the like can be used to support the frame with respect to the rim. The numerous bases used to support backboards in the art can be used for these purposes.

It also should be noted that the embodiments of FIG. 1 and FIG. 17 can be manufactured without a rear panel and without a basketball rim, whereby they can be positioned against an existing backboard and rim to achieve the purposes of the invention.

As used herein, wedge-shaped collapsible panels and fan-shaped collapsible panels does not require symmetry between the panels or exact triangular shapes. Instead, the device of the present invention is configured similar to a fan, whereby arms are held close to one another at one end and permitted to separate substantially greater distances at their opposite ends as with a fan. As described above, the ends of the arms need not be attached directly to one another to create the exact arrangement of the fan, but instead the invention is described herein as being similar to a fan, with wedge-shaped sections being collapsible upon themselves and pivotable into panels in the nature of a fan to create a V-shaped or a U-shaped channel for collecting a basketball.

It also in envisioned that the collapsible devices of the present invention can be assembled, for example, to a basketball rim attached to a flat wall. A string, rope or other collapsible material can be attached to the distal end of the chute support arms and the front support arms, the opposite end of such a collapsible material extending through the top of the framework to a position below the framework. One could simply pull on this material, to lift the chute and front support arms into a planer arrangement against the wall. Thus, a dozen or more of such devices could be aligned along a flat wall within a gym, released in the manner of a window shade into a use position, whereby foul shooting can be practiced without the need of numerous backboards and without taking up much court space.

It is also noted that in the embodiments depicted in FIGS. 1 and 17, it is preferred that the rim be 15" in diameter rather than 18" in diameter (which is regulation). The smaller diameter rim forces concentration and aids in improvement of foul-shooting ability. The frame of FIG. 18 also can have attached to it a 15" rim insert for defining a smaller hoop, and, optionally, supporting the frame on the rim.

Numerous other embodiments and equivalents will be apparent to those of ordinary skill in the art.

We claim:

1. A basketball retrieval device for use with a basketball rim, comprising;

a frame having, in a use position, a top and a bottom, the frame including:

a pair of first support arms spaced-apart from one another along their lengths, the first support arms defining a pair of first flexible wall attachment locations toward the top of the frame, the first flexible wall attachment locations spaced between 20" and 72" from one another, and a pair of second support arms attached to the first support arms and pivotable with respect to the first support arms, each second support arm having a proximal end adjacent the first support arms and a distal end in the use position remote from the first support arms, the distal ends defining second flexible wall attachment locations spaced between 30" and 72" from one another, and each distal end spaced-apart from its respective first flexible wall attachment location by between 30" and 72", the second support arms spaced-apart laterally from one another along their lengths;

a chute having a proximal end at or below the first support arms and a distal end remote from the first support arms, the chute being at least 48" in length and extending over most of its length downwardly from the first support arms at an angle of between 10 and 45 degrees from horizontal, a first flexible, collapsible wall attached to one of the first flexible wall attachment locations and to its respective second flexible wall attachment location and attached along a length of at least 48" of a first side of the chute, and a second flexible, collapsible wall attached to the other of the first flexible wall attachment locations and to its respective second flexible wall attachment location and attached along a length of at least 48" of a second side of the chute, wherein the second support arms are pivotable from the use position to a storage position in which the second support arms lie substantially parallel to the first support arms and in which the flexible, collapsible wall is collapsed.

2. The basketball retrieval device of claim 1, further comprising means for securing the frame with respect to a basketball rim and positioning the first flexible wall attachment locations behind the rim and at least 24" above the basketball rim.

3. The basketball retrieval device of claim 1, further comprising collapsible material attached to the frame at the first support arms and attached to the second support arms, a first length of the collapsible material limiting pivotable movement of the second support arms and defining, by such limiting, the use position of the second support arms.

4. The basketball retrieval device of claim 3, wherein the flexible collapsible wall is netting and wherein the collapsible material is fabric defining a border of the netting.

5. The basketball retrieval device of claim 3, further comprising collapsible material attached to the second support arms and to the chute, a second length of the collapsible material limiting pivotable movement of the chute and defining, by such limiting, the use position of the chute.

6. The basketball retrieval device of claim 1, wherein the frame further comprises a rigid frame member attached to the distal end of the chute.

7. The basketball retrieval device of claim 1, wherein the frame further comprises a cross-bar attached to the first support arms with stops for locating the cross-bar on a neck of a basketball rim.

8. The basketball retrieval device of claim 1, wherein the frame further comprises a pair of L-shaped arms extending behind the first support arm plane for engaging a backboard.

9. The basketball retrieval device of claim 1, wherein the frame further comprises means for securing the device to a basketball rim.

10. The basketball retrieval device of claim 1, wherein the chute has rigid sides and wherein the chute is pivotally attached to the frame, whereby the chute can be moved from the use position to a storage position in which the chute is substantially parallel to a plane defined by the first support arms.

11. The basketball retrieval device of claim 1, wherein the distal ends of the second support arms and the distal end of the chute define a trapezoidal opening.

12. The basketball retrieval device of claim 1, wherein the chute has rigid sides connected by a chute cross-bar at the distal end of the chute, and wherein the cross-bar is remote from a plane defined by the rigid sides.

13. The basketball retrieval device of claim 1, wherein the frame further comprises an extendable, telescoping arm, the telescoping arm extendable downwardly from the bottom of the frame for lifting the frame to a rim or backboard.

14. A framework for attachment to a basketball rim, comprising a first pair of arms lying in a plane and spaced-apart from one another along their lengths, a second pair of arms spaced-apart from one another along their lengths, the second pair pivotally attached to the framework and movable between a storage position, in which the second pair of arms is substantially parallel to the plane, and a use position, in which the second pair of arms extends outwardly and upwardly from the plane when the framework is oriented for attachment to a rim, a third pair of arms spaced-apart from one another along their lengths, the third pair of arms pivotally attached to the framework and moveable between a storage position in which the third pair of arms is substantially parallel to the plane, and a use position, in which the third pair of arms extends outwardly and downwardly from the plane when the framework is oriented for attachment to a rim, means attached to the second pair of arms and the third pair of arms for limiting pivotable movement of the second and third pair of arms and defining the use position by limiting such pivotable movement, and means for attaching the framework to a basketball rim.

15. The framework of claim 14, wherein the means for attaching the framework to a rim attaches the framework indirectly to the basketball rim via attachment to a basketball backboard.

16. The framework of claim 14, wherein the means for attaching the framework to the basketball rim comprises a cross-bar of said framework.

17. The framework of claim 16, wherein the cross-bar includes stops for locating the framework on a neck of the basketball rim.

18. The framework of claim 14, further comprising a pair of cross-bars attached to the first pair of arms.

19. The framework of claim 14, further comprising at least one extendable arm attached to the framework for lifting the framework to its placement about a basketball rim.

20. The framework of claim 14, wherein the attachment means comprises L-shaped arms attached to the framework and extending in two directions outside of the plane.

21. The framework of claim 14, further comprising a pair of collapsible walls attached to the arms, and wherein the arms and the walls are configured as a pair of wedge-shaped fans.

22. The framework of claim 14, further comprising a pair of extendable arms telescoping with said framework.

23. The framework of claim 22, wherein each extendable arm telescopes with a respective one of the first pair of arms.

24. The framework of claim 14, wherein the first pair of arms forms with the second pair of arms substantially a right triangle in the use position.

25. The framework of claim 14, wherein the means attached to the second pair of arms and the third pair of arms for limiting pivotable movement of the second and third pair of arms is collapsible material.

26. A framework for attachment to a basketball rim, comprising:

a first pair of arms lying in a plane and spaced-apart from one another along their lengths, a second pair of arms spaced-apart from one another along their lengths, and forming on the upper side thereof with the first pair of arms an acute angle, and a third pair of arms spaced-apart from one another along their lengths, the third pair of arms forming on the upper side thereof with the first pair of arms an obtuse angle, and a collapsible wall attached to the first, second and third pair of arms.

27. The framework of claim 26, wherein the wall is a collapsible wall and wherein the second arms and third arms are pivotably attached to the framework.

28. The framework of claim 27, wherein the second pair of arms and the third pair of arms are pivotable into a storage position in which the second pair of arms and the third pair of arms lie substantially in the plane.

29. The framework of claim 26, further comprising cross-bars attaching the first pair of arms to one another.

30. The framework of claim 26, further comprising retractable lift-arms received telescopically within the first pair of arms.

31. The framework of claim 26, wherein each of the second pair of arms has an end adjacent the plane of the first pair of arms and each of the third pair of arms has an end adjacent the plane defined by the first pair or arms, and wherein the ends of the second pair of arms are spaced vertically from the ends of the third pair of arms by at least 6".

32. A basketball retrieval device comprising a backboard defining a plane, a rim attached to the backboard, a pair of collapsible panels detachably secured to one of or both of the rim and backboard, one of said panels on a left side of the rim and extending from the backboard forward of the rim, and the other of the said panels on a right side of the rim and extending from the backboard forward of the rim, the pair of panels having top front corners and bottom front corners, wherein the bottom front corners are spaced-apart at a first distance and the top front corners are spaced-apart at a second distance, and wherein the second distance is at least 50% longer than the first distance, and a chute having two sides, each side of the chute attached along its length to a respective panel, the chute being at least 48" in length.

33. The basketball retrieval device of a claim 32, wherein the chute is free of attachment to any structure contacting a basketball playing surface other than via a post arrangement supporting the backboard.

34. The basketball retrieval device of claim 32, wherein the panels comprise a plurality of arms pivotable into parallel alignment with the plane.

35. The basketball retrieval device of claim 32, wherein each panel has a top side, the top sides positioned along their lengths at least 20" above the rim.

36. The basketball retrieval device of claim 32, each panel being a trapezoid comprising:

a vertical side extending parallel to the plane adjacent the backboard, a top side positioned at least 12" above the rim along its length, a front side longer than the top side and extending from the top side downwardly and forming with the top side an obtuse angle, and a bottom side extending downwardly from the vertical side to the front side and forming with the front side an acute angle.

37. The basketball retrieval device of claim 32, wherein the panels are collapsible to a configuration substantially parallel to the plane.

38. The basketball retrieval device of claim 32, wherein the chute is supported by a pair of arms pivotable into parallel alignment with the plane.

39. The basketball retrieval device of claim 32, wherein each collapsible panel comprises netting, fabric attached to the netting and a plurality of arms attached to the fabric, each panel configured as a wedged fan.

40. The basketball retrieval device of claim 32, wherein each collapsible panel comprises a plurality of support arms, each of said plurality of support arms received in a fabric sleeve substantially along its length.

41. The basketball retrieval device of claim 32, wherein the panels are supported on a frame which is detachably secured to the rim by a cross-bar on said frame.

42. A basketball hoop arrangement comprising:

an upright support, having a front and a side a basketball rim attached to the upright support and defining with the upright support a center plane, a front net support arm attached to the upright support, extending frontwardly and upwardly from the support and ending at a first net suspension point at least 18" above the rim, not more than 30" to the side of the rim, and at least 12" in front of the rim, wherein the front net support arm is positioned on a single side of the center plane, and a net supported on the front net support arm for restricting lateral movement of a ball bouncing off of the rim.

43. The basketball hoop arrangement of claim 42, further comprising;

a side net support arm attached to the upright support and extending sidewardly and upwardly from the upright support and ending at a second net suspension point at least 20" above the rim and behind and to the side of the rim, wherein the net is also supported on the side net support arm.

44. The basketball hoop arrangement of claim 42, wherein the front net support arm is a pair of front net support arms, one of said pair extending only on a left side of the center plane and the other of the pair extending only on a right side of the center plane, and wherein said first net suspension point is a pair of first net suspension points, one on the left side of the center plane and another on the right side of the center plane, and spaced apart from one another by at least 30".

45. The basketball hoop arrangement of claim 44, further comprising;

a pair of side net support arms attached to the upright support and extending sidewardly and upwardly from the upright support and ending at a pair of second net suspension points at least 20" above the rim and behind the rim, one of the second net suspension points on the left side of the center plane and the other on the right side of the center plane.

46. A basketball retrieval device comprising;

an upright support, a basketball rim attached to the support, a flexible wall arrangement attached to the support, wherein the wall arrangement includes two side panels, each side panel including a first wedge segment and a second wedge segment, a pair of pivotable arms, pivotable from the storage position in which the first wedge segments are collapsed, to a use position in which the first wedge segments are configured as triangles, wherein the first and second wedge segments of each side panel share a side defined by one of the pivotable arms, and a chute attached to a side of each of the second wedge segments.

47. The basketball retrieval device of claim 46, wherein the side panels comprise netting.

48. The basketball retrieval device of claim 46, wherein the wedge segments are substantially triangular.

* * * * *